US006850131B2

(12) United States Patent
Kundu

(10) Patent No.: US 6,850,131 B2
(45) Date of Patent: Feb. 1, 2005

(54) BANDPASS FILTER

(75) Inventor: Arun Chandra Kundu, Phoenix, AZ (US)

(73) Assignee: TDK Corporation, Tokyo (JP)

( * ) Notice: Subject to any disclaimer, the term of this patent is extended or adjusted under 35 U.S.C. 154(b) by 97 days.

(21) Appl. No.: 10/210,569

(22) Filed: Jul. 31, 2002

(65) Prior Publication Data

US 2003/0025577 A1 Feb. 6, 2003

(30) Foreign Application Priority Data

Aug. 3, 2001 (JP) ..... 2001-237038

(51) Int. Cl.[7] ..... H01P 1/20; H01P 1/219
(52) U.S. Cl. ..... 333/202; 333/210; 333/212
(58) Field of Search ..... 333/134, 202, 333/204, 208, 210, 212

(56) References Cited

U.S. PATENT DOCUMENTS

| | | | | | |
|---|---|---|---|---|---|
| 4,837,535 | A | * | 6/1989 | Konishi et al. | 333/210 |
| 5,010,309 | A | * | 4/1991 | Manssen et al. | 333/206 |
| 5,929,725 | A | * | 7/1999 | Toda et al. | 333/202 |
| 6,002,306 | A | * | 12/1999 | Arakawa | 333/134 |
| 6,166,612 | A | | 12/2000 | Tsujiguchi | 333/204 |
| 6,563,402 | B2 | * | 5/2003 | Kundu | 333/202 |
| 6,621,381 | B1 | * | 9/2003 | Kundu et al. | 333/202 |

FOREIGN PATENT DOCUMENTS

| | | | | |
|---|---|---|---|---|
| EP | 1 024 548 | A1 | 8/2000 | |
| EP | 1213785 | A1 * | 6/2002 | H01P/1/208 |
| EP | 1244171 | A1 * | 9/2002 | H01P/1/208 |
| JP | 2000-068711 | | 3/2000 | |
| JP | 2000114812 | | 4/2000 | |
| JP | 2000-183616 | | 6/2000 | |

OTHER PUBLICATIONS

Kundu, A. C. et al., "TEM–Mode Planar Dielectric Waveguide Resonator BPF for W–CDMA," 2000 IEEE MTT–S Digest, pp. 191–194.

Awai, I. et al., "Distributed Coupling of Dual–Modes in a Circular Resonator and Low–Profile Dielectric Disk Resonator BPF," IEICE Transactions on Electronics, vol. E82–C No. 2, Feb. 1999, pp. 393–401.

Konishi, Y., "Novel Dielectric Waveguide Components–Microwave Applications of New Ceramic Materials," Proceedings of the IEEE, vol. 79, No. 6, Jun. 1991, pp. 726–740.

Hwang, H. Y. et al., "A Novel $TE_{10\delta}$ Rectangular Waveguide Resonator and Its Bandpass Filter applications," Dept. of electronics Engineering, Sogang University, pp. 86–89, Sep. 2000 David Carlson.

Kubo, H. et al., "Design and Fabrication of Band Pass Filters Based on a Dielectric E–Plane Waveguide," *IEEE MTT–S International Microwave Symposium Digest 1*:241–244, May 23, 1994.

* cited by examiner

*Primary Examiner*—Michael Tokar
*Assistant Examiner*—Khai M. Nguyen
(74) *Attorney, Agent, or Firm*—Seed IP Law Group PLLC

(57) ABSTRACT

A highly compact bandpass filter that has excellent mechanical strength is disclosed. A bandpass filter according to the present invention employs a dielectric block of substantially rectangular prismatic shape constituted of a first portion lying between a first cross-section of the dielectric block and a second cross-section of the dielectric block substantially parallel to the first cross-section and second and third portions divided by the first portion and metal plates formed on surfaces of the dielectric block. The first portion of the dielectric block and the metal plates formed thereon are enabled to act as an evanescent waveguide. The second portion of the dielectric block and the metal plates formed thereon are enabled to act as a first resonator. The third portion of the dielectric block and the metal plates formed thereon are enabled to act as a second resonator. The metal plates include an inductive stub formed on the surface of the first portion of the dielectric block.

24 Claims, 28 Drawing Sheets

BANDPASS FILTER

BACKGROUND OF THE INVENTION

The present invention relates to a bandpass filter, and particularly, to a highly compact bandpass filter that has excellent mechanical strength.

DESCRIPTION OF THE PRIOR ART

In recent years, marked advances in miniaturization of communication terminals, typically mobile phones, has been achieved thanks to miniaturization of the various components incorporated therein. One of the most important components incorporated in a communication terminal is a filter component.

As one type of filter component, Japanese Patent Laid Open No. 2000-68711 and Japanese Patent Laid Open No. 2000-183616, for example, teach bandpass filters comprising a dielectric block formed with a plurality of holes whose inner walls are coated with metal plates. As another type of filter component, bandpass filters constituted by forming metal plates on irregular surfaces of a dielectric block are described in "Novel Dielectric Waveguide Components—Microwave Applications of New Ceramic Materials (PROCEEDINGS OF THE IEEE, VOL.79, NO.6, JUNE 1991), p734, FIG. 31."

As a need continues to be felt for still further miniaturization of communication terminals such as mobile phones, further miniaturization of filter components, e.g., bandpass filters, incorporated therein is also required.

The mechanical strength of the above-mentioned types of filter components is, however, low because holes are formed in, or irregularities are formed on, the dielectric block constituting the main body. Miniaturization of the filter component is therefore impossible. Specifically, in the former type of filter component having holes formed in a dielectric block, mechanical strength of the dielectric block is low around the holes and in the latter type of filter component having irregularities formed on the surface of a dielectric block, mechanical strength is low around the recesses. Therefore, miniaturization of the filter component must be limited to ensure the mechanical strength at such portions.

Thus, in the prior art it is difficult to miniaturize filter components while ensuring sufficient mechanical strength. Therefore, a compact bandpass filter that has excellent mechanical strength is desired.

SUMMARY OF THE INVENTION

It is therefore an object of the present invention to provide a compact bandpass filter having excellent mechanical strength.

The above and other objects of the present invention can be accomplished by a bandpass filter comprising a dielectric block of substantially rectangular prismatic shape constituted of a first portion lying between a first cross-section of the dielectric block and a second cross-section of the dielectric block substantially parallel to the first cross-section and second and third portions divided by the first portion and metal plates formed on surfaces of the dielectric block, thereby enabling the first portion of the dielectric block and the metal plates formed thereon to act as an evanescent waveguide, the second portion of the dielectric block and the metal plates formed thereon to act as a first resonator, and the third portion of the dielectric block and the metal plates formed thereon to act as a second resonator, the metal plates including at least one inductive stub formed on the surface of the first portion of the dielectric block.

According to this aspect of the present invention, because a predetermined coupling coefficient is established between the first and second resonators by the inductive stub formed on the first portion of the dielectric block, a bandpass filter can be configured by using a dielectric block of substantially rectangular prismatic shape. Since the bandpass filter according to the present invention has a substantially rectangular prism shape, its mechanical strength becomes very high. Therefore, highly compact size and excellent mechanical strength can be obtained.

In a preferred aspect of the present invention, inductive stubs are formed on two opposite surfaces of the first portion of the dielectric block.

In a further preferred aspect of the present invention, the metal plates further include a portion formed on substantially all of a surface of the dielectric block which is substantially perpendicular to the surface on which the inductive stub is formed.

In a further preferred aspect of the present invention, the metal plates further include a capacitive stub formed on the surfaces of the second and third portions of the dielectric block.

According to this preferred aspect of the present invention, because the resonance frequency is lowered owing to the capacitive stub formed on the surfaces of the second and third portions of the dielectric block, the overall size of the bandpass filter can be further reduced. Further, the capacitive stub lowers the radiation loss.

In a further preferred aspect of the present invention, the bandpass filter is symmetrical with respect to a cross-section that divides the dielectric block in half.

In another preferred aspect of the present invention, the bandpass filter is symmetrical with respect to an axis passing through a center of the dielectric block.

The above and other objects of the present invention can be also accomplished by a bandpass filter comprising:

a dielectric block having a top surface, a bottom surface, first and second side surfaces opposite to each other and third and fourth side surfaces opposite to each other, the dielectric block being constituted of a first portion lying between a first cross-section of the dielectric block substantially parallel to the first side surface and a second cross-section of the dielectric block substantially parallel to the first cross-section, a second portion lying between the first side surface and the first cross-section, and a third portion lying between the second side surface and the second cross-section;

a first metal plate formed on the top surface of the dielectric block;

a second metal plate formed on the bottom surface of the dielectric block;

a first exciting electrode formed on at least one of the first side surface, the third side surface, the fourth side surface, and the bottom surface of the second portion of the dielectric block;

a second exciting electrode formed on at least one of the second side surface, the third side surface, the fourth side surface, and the bottom surface of the third portion of the dielectric block;

a first inductive stub formed on substantially all of the third side surface of the first portion of the dielectric block; and a second inductive stub formed on substantially all of the fourth side surface of the first portion of the dielectric block.

According to this aspect of the present invention, because a predetermined coupling coefficient is also established between the resonators by the first and second inductive stubs, a bandpass filter can be configured without forming any hole in, or any irregularities on the dielectric block. Therefore, highly compact size and excellent mechanical strength can be obtained.

In a preferred aspect of the present invention, the bandpass filter is substantially a rectangular prism in overall shape.

In a further preferred aspect of the present invention, the first metal plate and the second metal plate are short-circuited by the first and second inductive stubs.

In a further preferred aspect of the present invention, the second metal plate and the first exciting electrode are prevented from connecting and the second metal plate and the second exciting electrode are prevented from connecting.

In a further preferred aspect of the present invention, the bandpass filter further comprises a first capacitive stub formed on at least one of the third and fourth side surfaces of the second portion of the dielectric block and a second capacitive stub formed on at least one of the third and fourth side surfaces of the third portion of the dielectric block.

According to this preferred aspect of the present invention, because the resonance frequency is lowered owing to the first and second capacitive stubs, the overall size of the bandpass filter can be further reduced and radiation loss can be lowered.

In a further preferred aspect of the present invention, both the first and second capacitive stubs are connected to the second metal plate.

According to this preferred aspect of the present invention, the effect produced by the capacitive stubs can be enhanced.

In a further preferred aspect of the present invention, the bandpass filter further comprises a third capacitive stub formed on the first side surface of the dielectric block and a fourth capacitive stub formed on the second side surface of the dielectric block.

According to this preferred aspect of the present invention, the effect produced by the capacitive stubs can be more enhanced.

In a further preferred aspect of the present invention, the first capacitive stub and the third capacitive stub are connected to each other and the second capacitive stub and the fourth capacitive stub are connected to each other.

In a further preferred aspect of the present invention, the bandpass filter is symmetrical with respect to a cross-section that divides the dielectric block in half.

In another preferred aspect of the present invention, the bandpass filter is symmetrical with respect to an axis passing through a center of the dielectric block.

In a further preferred aspect of the present invention, the second portion of the dielectric block and a part of the first and second metal plates formed thereon are enabled to act as a first quarter-wave dielectric resonator and the third portion of the dielectric block and another part of the first and second metal plates formed thereon are enabled to act as a second quarter-wave dielectric resonator.

The above and other objects of the present invention can be also accomplished by a bandpass filter, comprising:

a dielectric block having a top surface, a bottom surface, first and second side surfaces opposite to each other and third and fourth side surfaces opposite to each other, the dielectric block being constituted of a first portion lying between a first cross-section of the dielectric block substantially parallel to the first side surface and a second cross-section of the dielectric block substantially parallel to the first cross-section, a second portion lying between the first side surface and the first cross-section, and a third portion lying between the second side surface and the second cross-section; and metal plates formed on the surfaces of the dielectric block, whereby a first resonation circuit is established in which the first side surface acts as its open end and the first cross-section acts as its short end and a second resonation circuit is established in which the second side surface acts as its open end and the second cross-section acts as its short end, the bandpass filter further comprising means for providing a $\pi$-type inductive circuit between the first resonation circuit and the second resonation circuit.

According to this aspect of the present invention, because a predetermined coupling coefficient is also established between the first and second resonators by the $\pi$-type inductive circuit provided therebetween, a bandpass filter can be configured without forming any hole in, or any irregularities on the dielectric block. Therefore, highly compact size and excellent mechanical strength can be obtained.

In a preferred aspect of the present invention, the bandpass filter is substantially a rectangular prism in overall shape.

In a further preferred aspect of the present invention, the bandpass filter further comprises means for establishing a first additional capacitance parallel to the first resonation circuit and means for providing a second additional capacitance parallel to the second resonation circuit.

According to this preferred aspect of the present invention, because the resonance frequency of the first and second resonance circuits is lowered owing to the first and second additional capacitances, overall size of the bandpass filter can be more miniaturized.

The above and other objects of the present invention can be also accomplished by a bandpass filter comprising first and second quarter-wave dielectric resonators each having an open end and a short end opposite to the open end and having metal plates provided on top and bottom surfaces and a first evanescent waveguide provided between the short end of the first quarter-wave dielectric resonator and the short end of the second quarter-wave dielectric resonator, the bandpass filter being substantially a rectangular prism in overall shape.

In a preferred aspect of the present invention, the bandpass filter further comprising a third quarter-wave dielectric resonator having an open end and a short end opposite to the open end and having metal plates provided on top and bottom surfaces and a second evanescent waveguide provided between the open end of the second quarter-wave dielectric resonator and the open end of the third quarter-wave dielectric resonator.

In a further preferred aspect of the present invention, the bandpass filter further comprising a fourth quarter-wave dielectric resonator having an open end and a short end opposite to the open end and having metal plates provided on top and bottom surfaces and a third evanescent waveguide provided between the short end of the third quarter-wave dielectric resonator and the short end of the fourth quarter-wave dielectric resonator.

In another preferred aspect of the present invention, the bandpass filter further comprising a fourth quarter-wave dielectric resonator having an open end and a short end opposite to the open end and having metal plates provided on top and bottom surfaces and a third evanescent waveguide provided between the open end of the first quarter-wave dielectric resonator and the open end of the fourth quarter-wave dielectric resonator.

The above and other objects and features of the present invention will become apparent from the following description made with reference to the accompanying drawings.

DESCRIPTION OF THE PREFERRED EMBODIMENT

Preferred embodiments of the present invention will now be explained with reference to the drawings.

Figure 1:
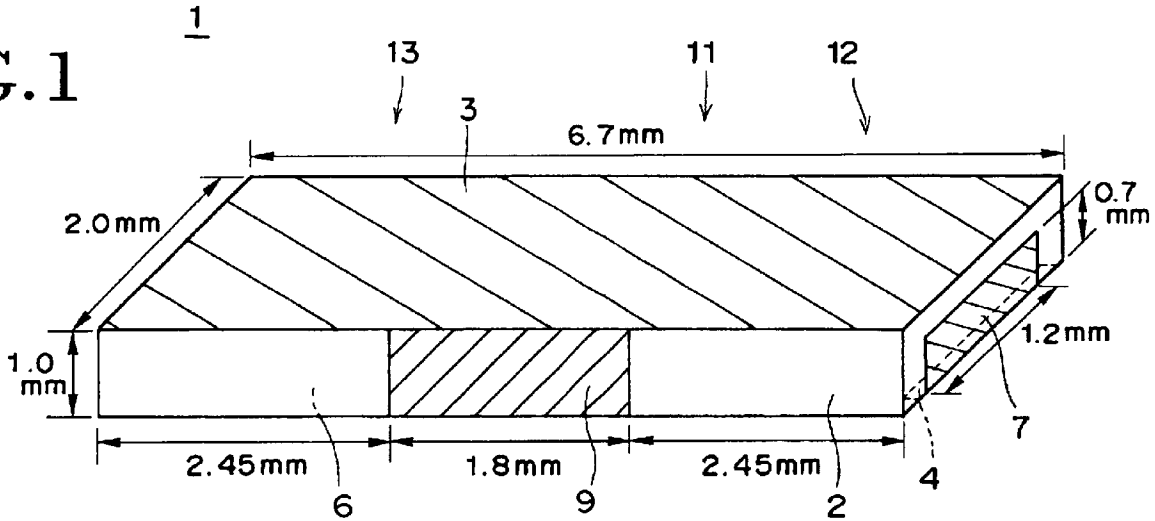
FIG. 1 is a schematic perspective view from one side showing a bandpass filter 1 that is a preferred embodiment of the present invention.
Figure 2:
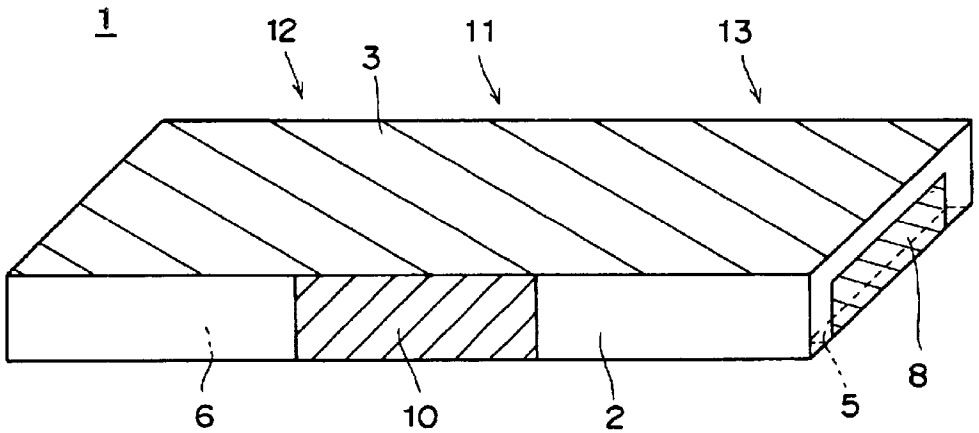
FIG. 2 is a schematic perspective view from the opposite side showing the bandpass filter 1 of FIG. 1.

As shown in FIGS. 1 and 2, a bandpass filter 1 that is a preferred embodiment of the present invention is constituted of a dielectric block 2 and various metal plates formed on the surface thereof The dielectric block 2 is made of dielectric material whose dielectric constant $\in_r$ is 37, for example, and has the shape of a rectangular prism whose length, width, and thickness are 6.7 mm, 2.0 mm, and 1.0 mm. That is, the dielectric block 2 has no holes or surface irregularities.

Further, the dielectric block 2 is composed of a first portion lying between a first cross-section and a second cross-section parallel to the first cross-section and second and third portions divided by the first portion. It is worth noting that this does not mean that the dielectric block 2 is a combination of the first to third portions of physically different components. The dielectric block 2 constitutes a single dielectric unit, i.e., the first to third portions are names used solely for convenience of description.

The first portion of the dielectric block 2, whose length, width, and thickness are 1.8 mm, 2.0 mm, and 1.0 mm, is located at the center of the rectangular prismatic dielectric block 2. The second and third portions of the dielectric block 2 are symmetrically located relative to the first portion. Each measures 2.45 mm, 2.0 mm, and 1.0 mm in length, width and thickness. Directions defining the "length," "width," and "thickness" of the first to third portions are the same as the directions defining the "length," "width," and "thickness" of the dielectric block 2.

The dielectric block 2 has a top surface, a bottom surface, and four side surfaces. Among the four side surfaces of the dielectric block 2, the end surface of the second portion is defined as a "first side surface," end surface of the third portion is defined as a "second side surface," and the remaining surfaces are defined as a "third side surface" and a "fourth side surface." Therefore, both the top and bottom surfaces measure 6.7 mm (length)×2.0 mm (width), both the first and second side surfaces measure 1.0 mm (thickness)× 2.0 mm (width), and both the third and fourth side surfaces measure 6.7 mm (length)×1.0 mm (thickness).

As shown in FIGS. 1 and 2, a metal plate 3 is formed on the entire top surface of the dielectric block 2. A metal plate 6 is formed on the bottom surface of the dielectric block 2 except at clearance portions 4 and 5.

As shown in FIG. 1, an exciting electrode 7, whose height and width are 0.7 mm and 1.2 mm, is formed on the first side surface of the dielectric block 2 where the clearance portion 4 prevents the exciting electrode 7 from being in contact with the metal plate 6 formed on the bottom surface. Similarly, as shown in FIG. 2, an exciting electrode 8, whose height and width are 0.7 mm and 1.2 mm, is formed on the second side surface of the dielectric block 2 where the clearance portion 5 prevents the exciting electrode 8 from being in contact with the metal plate 6 formed on the bottom surface. One of the exciting electrodes 7 and 8 is used as an input electrode, and the other is used as an output electrode.

As shown in FIGS. 1 and 2, a first inductive stub 9, whose height and width are 1.0 mm and 1.8 mm, is formed on the third side surface of the dielectric block 2 corresponding to the first portion and a second inductive stub 10, whose height and width are 1.0 mm and 1.8 mm, is formed on the fourth side surface of the dielectric block 2 corresponding to the first portion. The first and second inductive stubs 9 and 10 are connected to the metal plates 3 and 6 formed on the top and bottom surfaces of the dielectric block 2. The metal plate 6 is grounded. The direction defining the "width" of the first and second inductive stubs 9 and 10 is coincident with the direction defining the "length" of the dielectric block 2.

The metal plates 3 and 6, the exciting electrodes 7 and 8, and the first and second inductive stubs 9 and 10 are made of silver. However, the present invention is not limited to using silver and other kinds of metal can be used instead. It is preferable to use a screen printing method to form them on the surfaces of the dielectric block 2.

No metal plate or electrode is formed on the remaining surfaces of the dielectric block 2, which therefore constitute open ends.

According to the above described structure, the first portion of the dielectric block 2 and the metal plate formed thereon act as an evanescent waveguide 11, the second portion of the dielectric block 2 and the metal plate formed thereon act as a first resonator 12, and the third portion of the dielectric block 2 and the metal plate formed thereon act as a second resonator 13. The evanescent waveguide 11 is an H-mode waveguide, and each of the first and second resonators 12 and 13 is a quarter-wave (λ/4) dielectric resonator.

The principle of the quarter-wave (λ/4) dielectric resonators constituted by the first resonator 12 and the second resonator 13 will now be explained.

Figure 3:
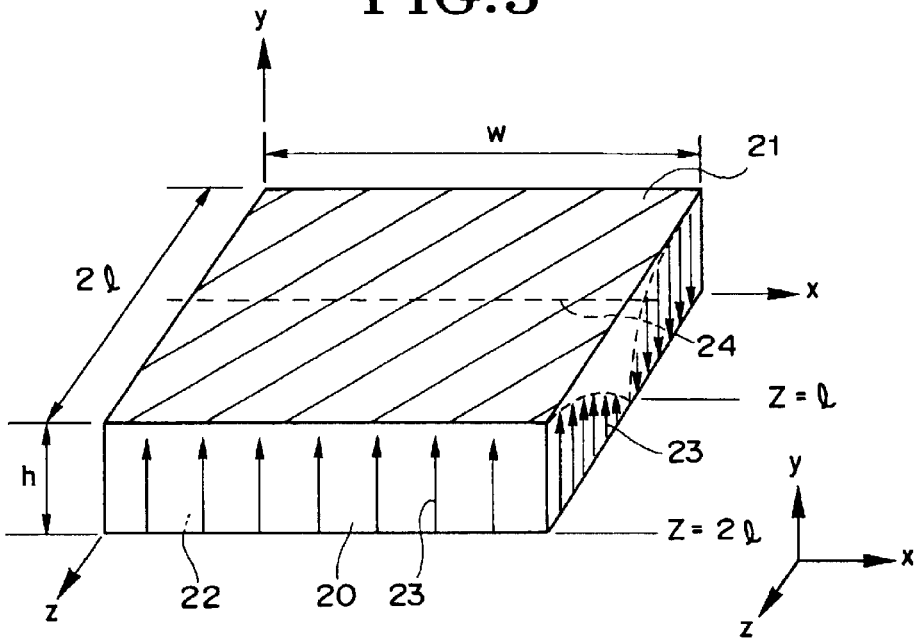
FIG. 3 is a schematic perspective view showing an ordinary TEM-mode half-wave ($\lambda/2$) dielectric resonator.

FIG. 3 is a schematic perspective view showing an ordinary TEM-mode half-wave (λ/2) dielectric resonator.

As shown in FIG. 3, the ordinary half-wave (λ/2) dielectric resonator is constituted of a dielectric block 20, a metal plate 21 formed on the upper surface of the dielectric block 20, and a metal plate 22 formed on the lower surface of the dielectric block 20. The metal plate 21 formed on the upper surface of the dielectric block 20 is electrically floated whereas the metal plate 22 formed on the lower surface of the dielectric block 20 is grounded. All of the four side surfaces of the dielectric block 20 are open to the air. In FIG. 3, the length and width of the dielectric block 20 are indicated by 2l and w.

For propagation of the dominant TEM-mode along the z direction of this half-wave (λ/2) dielectric resonator, if electric field is negative maximum in the z=0 plane, then it should be positive maximum in the z=2l plane as indicated by the arrow 23 in this Figure. Obviously there should be minimum (zero) electric field in the z=l plane, which is the symmetry plane 24 of the resonator.

Cutting such a half-wave (λ/2) dielectric resonator along the symmetry plane 24, two quarter-wave (λ/4) dielectric resonators can be obtained. In this quarter-wave (λ/4) dielectric resonator, the z=l plane acts as a perfect electric conductor (PEC).

Figure 4:
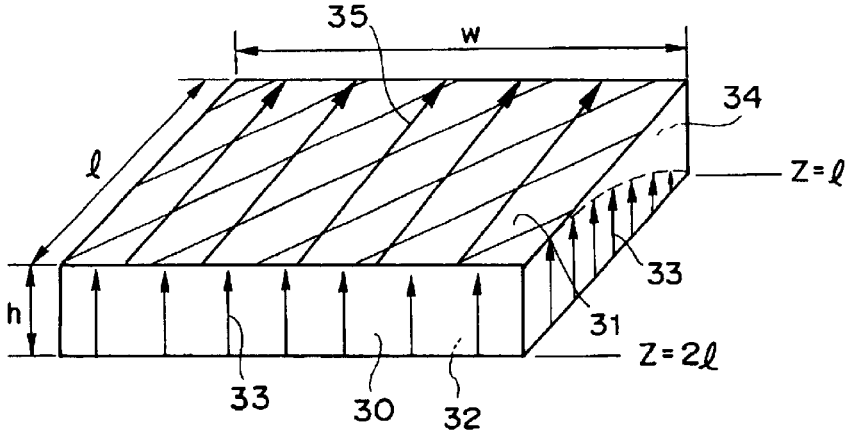
FIG. 4 is a schematic perspective view showing an ordinary quarter-wave ($\lambda/4$) dielectric resonator.

FIG. 4 is a schematic perspective view showing the quarter-wave (λ/4) dielectric resonator obtained by above described method.

As shown in FIG. 4, the quarter-wave (λ/4) dielectric resonator is constituted of a dielectric block 30, a metal plate 31 formed on the upper surface of the dielectric block 30, a metal plate 32 formed on the lower surface of the dielectric block 30, and a metal plate 34 formed on one of the side surfaces of the dielectric block 30. The remaining three side surfaces of the dielectric block 30 are open to the air. The metal plate 32 formed on the lower surface of the dielectric block 30 is grounded. The metal plate 34 formed on one of the side surfaces of the dielectric block 30 corresponds to the perfect electric conductor (PEC) of the half-wave (λ/2) dielectric resonator to short-circuit the metal plate 31 and the metal plate 32. In FIG. 4, arrows 33 indicate electric field, and arrows 35 indicate current flow.

Ideally, the quarter-wave (λ/4) dielectric resonator shown in FIG. 4 and the half-wave (λ/2) dielectric resonator shown in FIG. 3 should have the same resonant frequency. If a material having a relatively high dielectric constant is used for the dielectric block 30, electromagnetic field confinement inside the resonator is adequately strong. Moreover, the distribution of the electromagnetic field of the quarter-wave (λ/4) dielectric resonator becomes substantially the same as that of the half-wave (λ/2) dielectric resonator. As shown in FIGS. 3 and 4, the volume of the quarter-wave (λ/4) dielectric resonator is half the volume of the half-wave (λ/2) dielectric resonator. As a result, the total energy of the quarter-wave (λ/4) dielectric resonator is also half the total energy of the half-wave (λ/2) dielectric resonator. However, the unloaded quality factor ($Q_0$) of the quarter-wave (λ/4) dielectric resonator remain almost the same that of the half-wave (λ/2) dielectric resonator because the energy loss of the quarter-wave (λ/4) dielectric resonator decreases to around 50% that of the half-wave (λ/2) dielectric resonator. The quarter-wave (λ/4) dielectric resonator therefore enables miniaturization without substantially changing the resonant frequency and the unloaded quality factor ($Q_0$).

Figure 5:
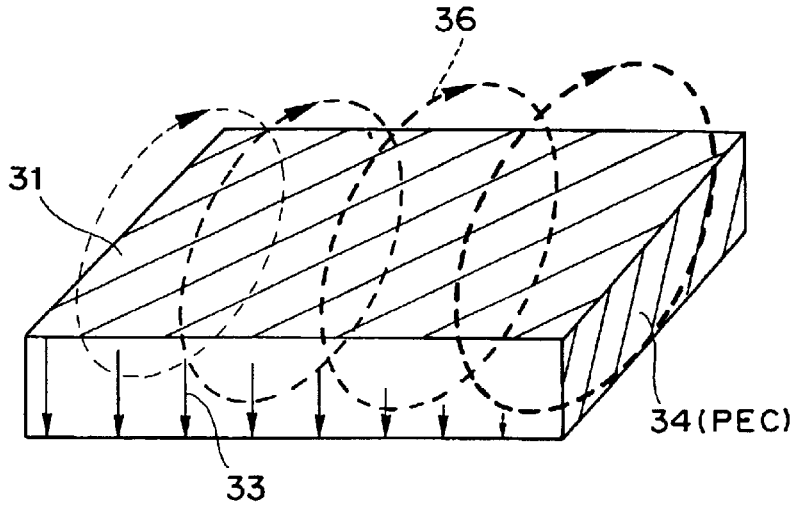
FIG. 5 is a schematic diagram for explaining an electric field and a magnetic field generated by a quarter-wave ($\lambda/4$) dielectric resonator.

FIG. 5 is a schematic diagram for explaining the electric field and the magnetic field generated by the quarter-wave (λ/4) dielectric resonator.

As shown in FIG. 5, the magnetic field 36 of the quarter-wave (λ/4) dielectric resonator is maximum throughout the metal plate 34 formed on one of the side surfaces of the dielectric block 30. By linking the metal plate 34, the magnetic field 36 imparts the effect of an additional series inductance to resonator equivalent circuit. Thus, the resonant frequency of the quarter-wave (λ/4) dielectric resonator becomes slightly lower than that of the half-wave (λ/2) dielectric resonator.

In this type of the quarter-wave (λ/4) dielectric resonator, the resonant frequency f can be represented by the following formula:

$$f = \frac{c}{4 \times l\sqrt{\varepsilon_{eff}}} \tag{1}$$

Where c represents the velocity of light in free space, l represents the length of the quarter-wave (λ/4) dielectric resonator, and $\in_{eff}$ represents the effective dielectric constant, which can be represented by:

$$\varepsilon_{eff} = \frac{\varepsilon_r + 1}{2} + \frac{\varepsilon_r - 1}{2}\left(1 + \frac{10h}{w}\right)^{-5} \tag{2}$$

where $\in_r$ represents the relative permittivity of the material of the dielectric block constituting the quarter-wave (λ/4) dielectric resonator, h represents the thickness of the quarter-wave (λ/4) dielectric resonator, and w represents the width of the quarter-wave (λ/4) dielectric resonator.

By referring the formulas (1) and (2), it is apparent that the resonant frequency mainly depends on the length of the dielectric block but has very little dependence upon thickness and width of the resonator. Specifically, the resonant frequency increases with shorter length of the dielectric block. A quarter-wave (λ/4) dielectric resonator having the desired resonant frequency can therefore be obtained by optimizing the length of the dielectric block constituting the quarter-wave (λ/4) dielectric resonator.

On the other hand, in this type of quarter-wave (λ/4) dielectric resonator, the unloaded quality factor ($Q_0$) depends on the thickness and the width of the dielectric block. Specifically, the unloaded quality factor ($Q_0$) of the quarter-wave (λ/4) dielectric resonator increases in proportion to the thickness of the dielectric block in a first thickness region of the dielectric block smaller than a predetermined thickness and decreases in proportion to the thickness of the dielectric block in a second thickness region of the dielectric block greater than the predetermined thickness. Further, the unloaded quality factor ($Q_0$) of the quarter-wave (λ/4) dielectric resonator increases in proportion to the width of the dielectric block in a first width region of the dielectric block smaller than a predetermined width and becomes substantially constant in a second width region of the dielectric block greater than the predetermined width. A quarter-wave (λ/4) dielectric resonator having the desired unloaded quality factor ($Q_0$) can therefore be obtained by optimizing the thickness and the width of the dielectric block constituting the quarter-wave (λ/4) dielectric resonator.

The bandpass filter 1 of this embodiment is constituted of two quarter-wave (λ/4) dielectric resonators, whose operating principle was explained in the foregoing, and an evanescent waveguide 11 which acts as an H-mode waveguide disposed therebetween.

Figure 6:
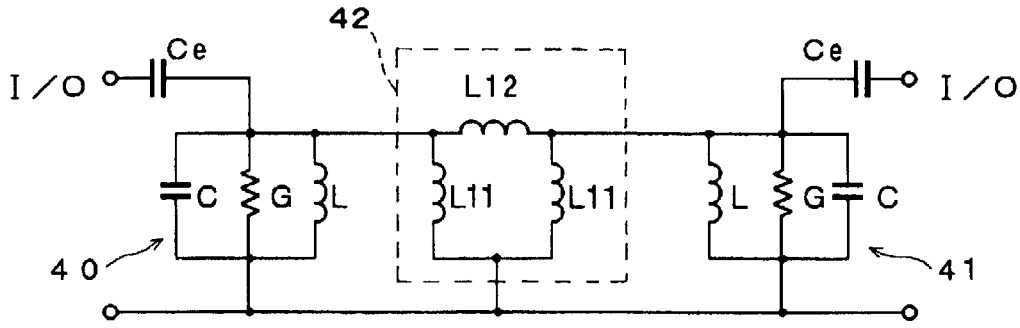
FIG. 6 is an equivalent circuit diagram of the bandpass filter 1 shown in FIGS. 1 and 2.

FIG. 6 is an equivalent circuit diagram of the bandpass filter 1 shown in FIGS. 1 and 2.

In this Figure, the first resonator 12 and the second resonator 13 are represented by two L-C parallel circuits 40 and 41, respectively. The conductance G represents loss factor of each resonator. The exciting electrodes 7 and 8 are represented by two capacitances Ce. The H-mode evanescent waveguide 11 is represented by the coupling inductance $L_{12}$ (internal coupling inductance) connected between the first resonator 12 and the second resonator 13 in series and a pair of shunt inductances $L_{11}$ which are grounded. That is, the evanescent waveguide 11 forms the π-type inductive circuit 42.

Figure 7:
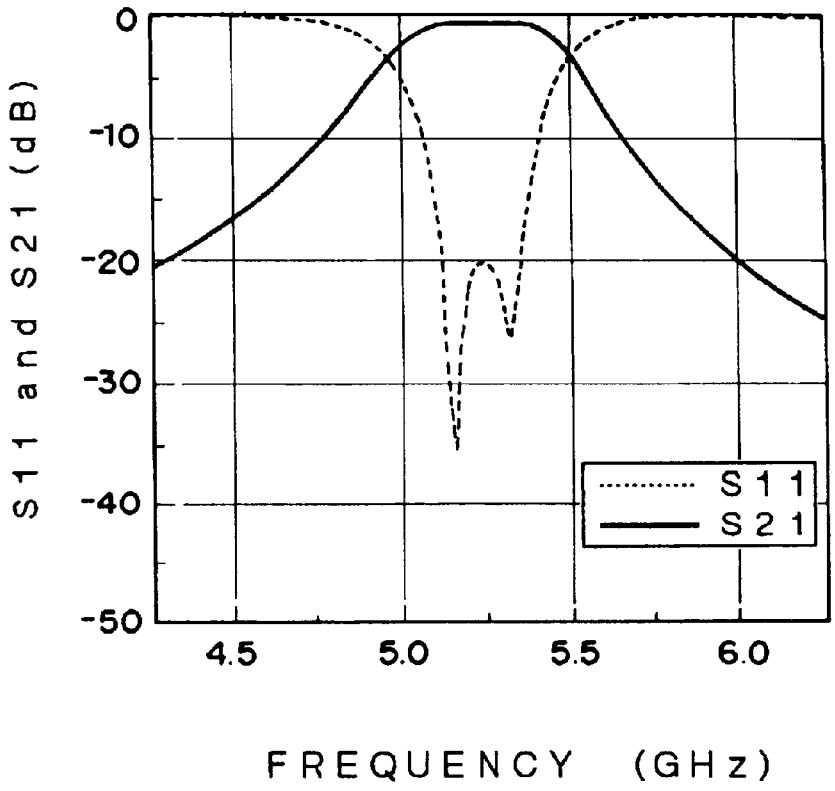
FIGS. 7 and 8 are graphs showing the frequency characteristic curve of the bandpass filter 1 shown in FIGS. 1 and 2.
Figure 8:
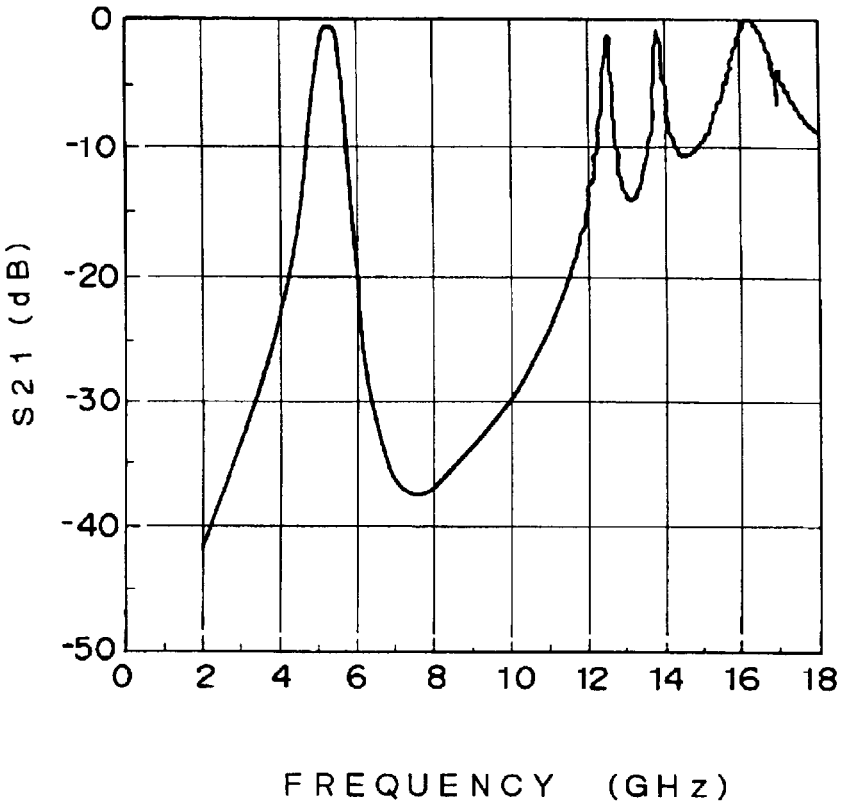

Both FIGS. 7 and 8 are graphs showing the frequency characteristic curve of the bandpass filter 1.

In FIGS. 7 and 8, S11 represents a reflection coefficient, and S21 represents a transmission coefficient. As shown in FIG. 7, the resonant frequency of the bandpass filter 1 is approximately 5.25 GHz and its 3-dB bandwidth is approximately 550 MHz. The insertion loss is approximately 0.6 dB. As shown in FIG. 8, the first spurious resonance frequency appears at more than 12 GHz which is sufficiently far from the dominant frequency.

The function of the first and second inductive stubs 9 and 10 of the bandpass filter 1 will be explained.

To explain the function of the first and second inductive stubs 9 and 10, a model in which exciting electrodes 7 and 8 and first and second inductive stubs 9 and 10 are eliminated from the bandpass filter 1 will be explained first.

Figure 9:
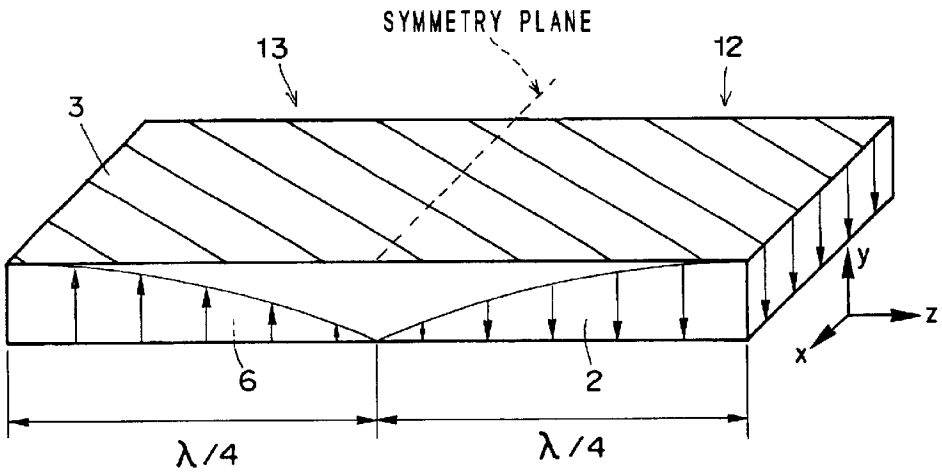
FIG. 9 is a schematic perspective view showing a model in which exciting electrodes 7 and 8 and first and second inductive stubs 9 and 10 are eliminated from the bandpass filter 1 shown in FIGS. 1 and 2.

FIG. 9 is a schematic perspective view showing a model in which exciting electrodes 7 and 8 and first and second inductive stubs 9 and 10 are eliminated from the bandpass filter 1 shown in FIGS. 1 and 2.

This model is constituted of the dielectric block 2 and the metal plates 3 and 6 formed on the entire top and bottom surfaces of the dielectric block 2. The metal plate 3 formed on the top surface of the dielectric block 2 is electrically floated whereas the metal plate 6 formed on the bottom surface of the dielectric block 2 is grounded. All of the first to fourth side surfaces of the dielectric block 2 are open to the air. In this model having such a configuration, the electric field is positive maximum at the first side surface of the dielectric block 2 and is negative maximum at the second side surface of the dielectric block. Further, the electric field is minimum at the symmetry plane which is the center plane of the dielectric block 2 in the length direction. That is, the model shown in FIG. 9 can be considered as the half-wave ($\lambda/2$) dielectric resonator explained with reference to FIG. 3.

The model shown in FIG. 9 can be also considered as two individual quarter-wave ($\lambda/4$) dielectric resonators, i.e., the first resonator 12 and the second resonator 13, whose short ends are coincident with the symmetry plane. In this model, however, no coupling is obtained between the first resonator 12 and the second resonator 13. Therefore, this model does not act as a filter.

Figure 10:
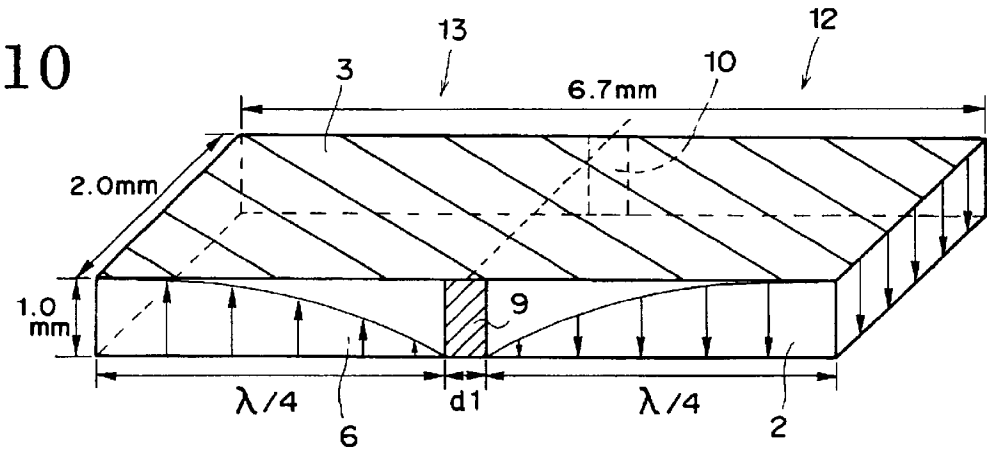
FIG. 10 is a schematic perspective view showing a model in which first and second inductive stubs 9 and 10 are added to the model shown in FIG. 9.

FIG. 10 is a schematic perspective view showing a model in which the first and second inductive stubs 9 and 10 are added to the third and fourth side surfaces of the dielectric block 2 of the model shown in FIG. 9 with their centers coincident with the symmetry plane.

As shown in FIG. 10, when the first and second inductive stubs 9 and 10 are added to the third and fourth side surfaces of the dielectric block 2 with their centers coincident with the symmetry plane, an inductive coupling occurs between the first resonator 12 and the second resonator 13 because the electric field is minimum around the portion that the first and second inductive stubs 9 and 10 are formed.

Figure 11:
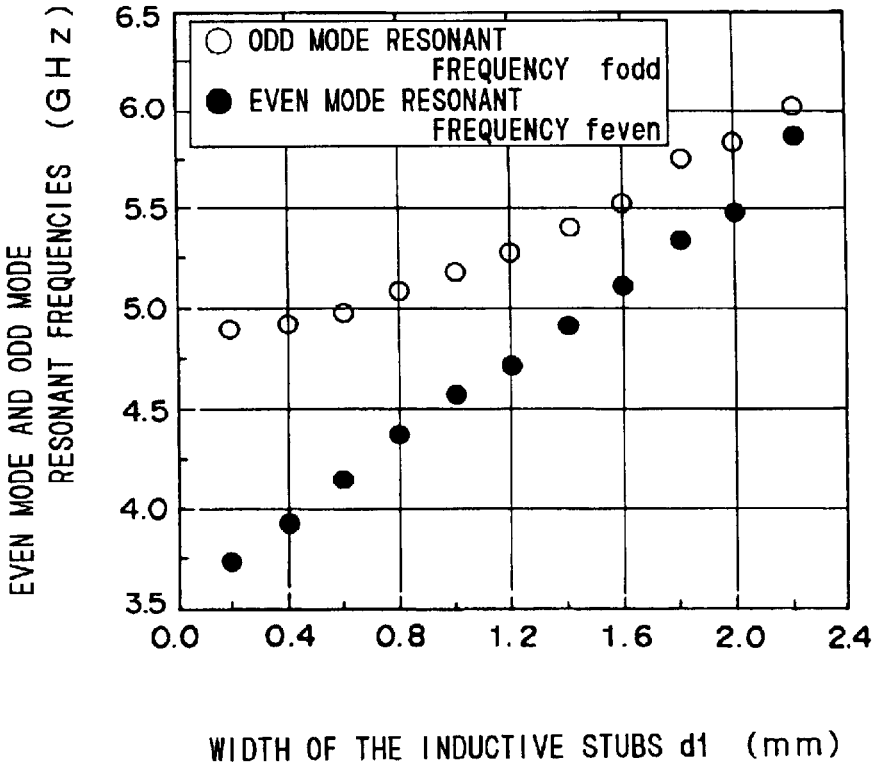
FIG. 11 is a graph showing the relationship between the width d1 of the first and second inductive stubs 9 and 10 and an even mode resonant frequency $f_{even}$ and an odd mode resonant frequency $f_{odd}$.

FIG. 11 is a graph showing the relationship between the width d1 of the first and second inductive stubs 9 and 10 and an even mode resonant frequency $f_{even}$ and an odd mode resonant frequency $f_{odd}$.

As mentioned earlier, the direction defining the "width" of the first and second inductive stubs 9 and 10 is coincident with the direction defining the "length" of the dielectric block 2. Further, height of the first and second inductive stubs 9 and 10 is the same as the thickness of the dielectric block 2, which is 1.0 mm.

As shown in FIG. 11, both the even mode resonant frequency $f_{even}$ and the odd mode resonant frequency $f_{odd}$ increase with increasing width d1 of the first and second inductive stubs 9 and 10, so that the effective resonant frequency $f(=(f_{even}+f_{odd})/2)$ also increases. As is apparent from FIG. 11, because the even mode resonant frequency $f_{even}$ increases more rapidly than the odd mode resonant frequency $f_{odd}$, the frequency difference between them decreases with increasing width d1 of the first and second inductive stubs 9 and 10. By this, it can be understood that the effective wavelength of the first and second resonators 12 and 13 shortens with increasing width d1 of the first and second inductive stubs 9 and 10. As a result, the effective resonant frequency $f(=(f_{even}+f_{odd})/2)$ increases.

The coupling constant k between the first resonator 12 and the second resonator 13 can be represented by the following formula.

$$k = \left|\frac{(f_{even}^2 - f_{odd}^2)}{(f_{even}^2 + f_{odd}^2)}\right| \tag{3}$$

where $f_{even}$ represents the even mode resonant frequency and $f_{odd}$ represents the odd mode resonant frequency. Therefore, a precise relationship between the width d1 of the first and second inductive stubs 9 and 10 and the coupling constant k by using the formula (3).

Figure 12:
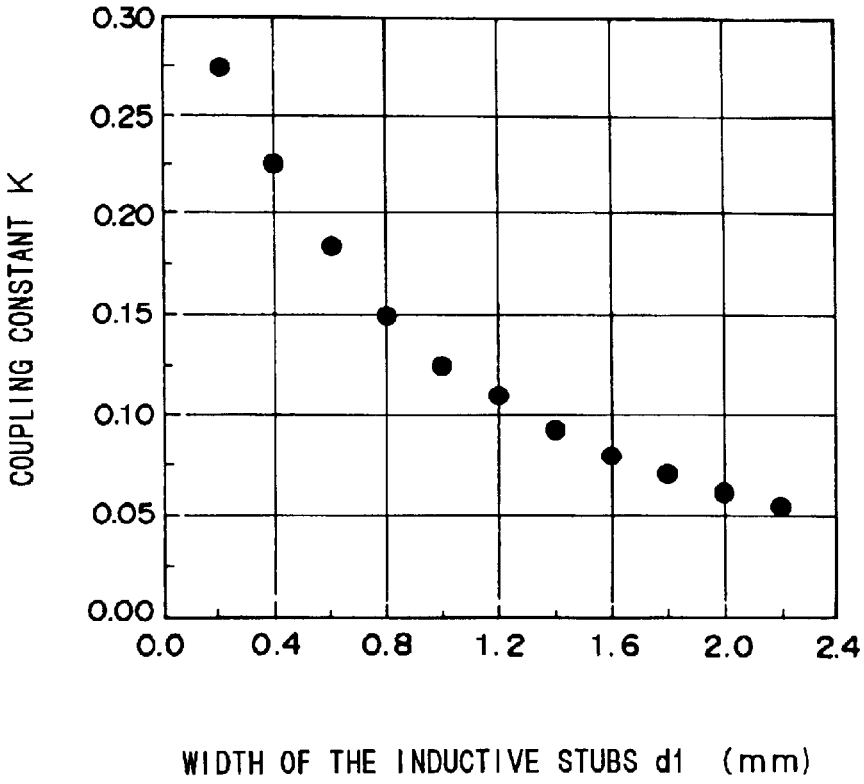
FIG. 12 is a graph showing the relationship between the width d1 of the first and second inductive stubs 9 and 10 and a coupling constant k.

FIG. 12 is a graph showing the relationship between the width d1 of the first and second inductive stubs 9 and 10 and the coupling constant k.

As shown in FIG. 12, the coupling constant k decreases with increasing width d1 of the first and second inductive stubs 9 and 10. As is apparent from foregoing, the first and second inductive stubs 9 and 10 give the bandpass filter 1 a filter function and a desired coupling constant k can be obtained by changing their width d1.

The coupling constant k can be also represented by the following formula.

$$k = \frac{B}{\sqrt{g_1 g_2} \times f_0} \tag{4}$$

where B represents a 3-dB bandwidth required for the bandpass filter, $f_0$ represents a dominant frequency required for the bandpass filter, and $g_1$ and $g_2$ are constants ($g_1=g_2=1.414$). Using the formula (4), it is found that a coupling constant k of 0.074 is required to design a bandpass filter whose resonant frequency is approximately 5.25 GHz and 3-dB bandwidth is approximately 550 MHz. In the case where the width d1 of the first and second inductive stubs 9 and 10 are set at 1.8 mm, a coupling constant k of approximately 0.074 can be obtained as shown in FIG. 12.

Further, the external quality factor ($Q_e$) can be adjusted by changing the area of the exciting electrodes. In the case where the area of the first and second exciting electrodes 7 and 8 are set at 1.2 mm×0.7 mm as in the bandpass filter 1 of this embodiment, a coupling external quality factor ($Q_e$) of approximately 13.9 can be obtained.

Because, as described above, the bandpass filter 1 according to this embodiment is constituted of the rectangular prismatic dielectric block 2 having no holes or surface irregularities and the metal plates 3 and 6, the exciting electrodes 7 and 8, and the first and second inductive stubs 9 and 10 formed on the surfaces thereof, the mechanical strength is extremely high compared with conventional filters. Thus, even if the overall size of the bandpass filter 1 is reduced, sufficient mechanical strength can be ensured.

Moreover, because the bandpass filter 1 according to this embodiment can be fabricated merely by forming the various metal plates on the dielectric block 2, i.e., because forming holes or irregularities is not necessary as in conventional filters, the fabrication cost can be substantially reduced.

In the bandpass filter 1, although the exciting electrodes are formed on the first and second side surfaces, respectively, the invention is not limited to forming these exciting electrodes on the first and second side surfaces and they can instead be formed other portions.

Figure 13:
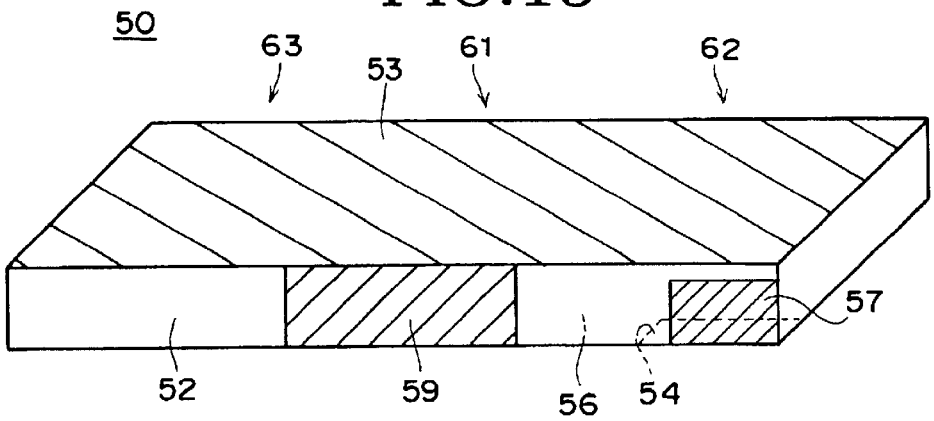
FIG. 13 is a schematic perspective view from one side showing a bandpass filter 50 which is an example having the exciting electrodes formed on the third and fourth side surfaces of the dielectric block.
Figure 14:
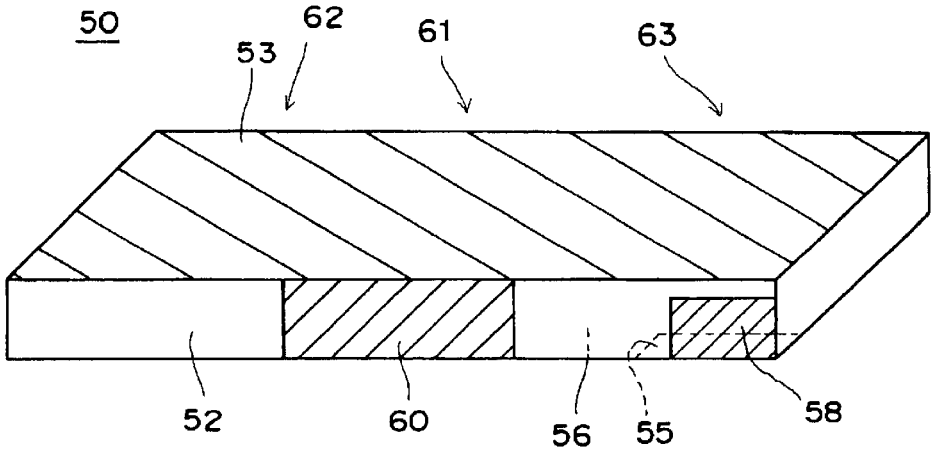
FIG. 14 is a schematic perspective view from the opposite side showing the bandpass filter 50 of FIG. 13.

FIG. 13 is a schematic perspective view from one side showing a bandpass filter 50 which is an example having the exciting electrodes formed on the third and fourth side surfaces of the dielectric block. FIG. 14 is a schematic perspective view from the opposite side showing the bandpass filter 50 of FIG. 13.

As shown in FIGS. 13 and 14, a bandpass filter 50 is constituted of a dielectric block 52 and various metal plates formed on the surfaces thereof. The dielectric block 52 is made of dielectric material whose dielectric constant $\in_r$ is 37, for example, and has the same shape as the dielectric block 2 constituting the bandpass filter 1 of above-mentioned embodiment. Further, the dielectric block 52 is composed of a first portion lying between a first cross-section and a second cross-section parallel to the first cross-section and second and third portions divided by the first portion, similarly to the dielectric block 2.

Further, a metal plate 53 is formed on the entire top surface of the dielectric block 52. A metal plate 56 is formed on the bottom surface of the dielectric block 52 except at clearance portions 54 and 55. As shown in FIG. 13, an exciting electrode 57 and a first inductive stub 59 are formed on the third side surface of the dielectric block 52 corresponding to a part of the second portion and the entire first portion, respectively. Similarly, as shown in FIG. 14, an exciting electrode 58 and a second inductive stub 60 are formed on the fourth side surface of the dielectric block 52 corresponding to a part of the third portion and the entire first portion, respectively.

The exciting electrodes 57 and 58 are prevented from being in contact with the metal plate 56 formed on the bottom surface of the dielectric block 52 by the clearance portions 54 and 55, respectively. Because the exciting electrodes 57 and 58 are formed at regions close to the first and second side surfaces, respectively, where the electric field is relatively strong, the exciting electrodes 57 and 58 can capacitively excite the bandpass filter 50, similarly to the bandpass filter 1 of the above-described embodiment.

The first and second inductive stubs 59 and 60 are connected to the metal plates 53 and 56 formed on the top and bottom surfaces of the dielectric block 52. By this, the metal plate 53 and the metal plate 56 are connected by the first and second inductive stubs 59 and 60. The metal plate 56 is grounded.

No metal plate or electrode is formed on the remaining surfaces of the dielectric block 52, which therefore constitute open ends.

According to the above described structure, the first portion of the dielectric block 52 and the metal plate formed thereon act as an evanescent waveguide 61, the second portion of the dielectric block 52 and the metal plate formed thereon act as a first resonator 62, and the third portion of the dielectric block 52 and the metal plate formed thereon act as a second resonator 63. Because the bandpass filter 50 employs the first and second inductive stubs 59 and 60, a predetermined coupling occurs between the first resonator 62 and the second resonator 63 so that the resonator structure 50 acts as a bandpass filter having desired characteristics, similarly to the bandpass filter 1.

According to the bandpass filter 50, because it is not necessary to form any metal plate or electrode on the first and second side surface of the dielectric block 52, the number of fabricating steps can be reduced compared with the bandpass filter 1.

Figure 15:
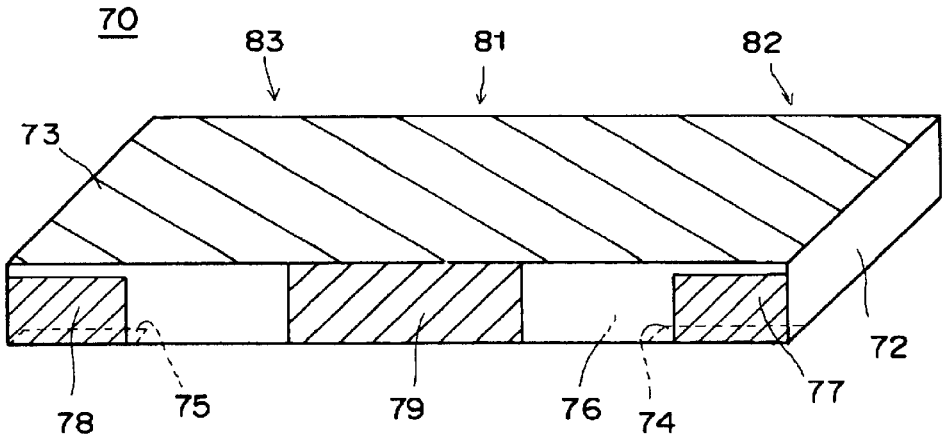
FIG. 15 is a schematic perspective view from one side showing a bandpass filter 70 which is an example having the exciting electrodes formed on the third side surface of the dielectric block.
Figure 16:
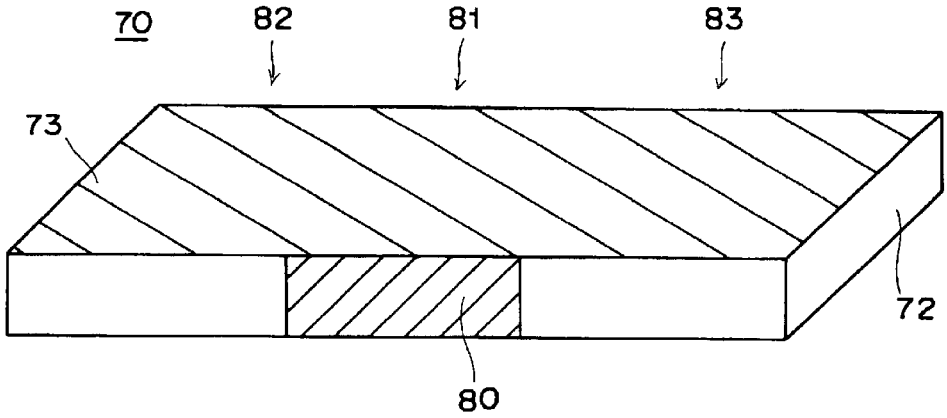
FIG. 16 is a schematic perspective view from the opposite side showing the bandpass filter 70 of FIG. 15.

FIG. 15 is a schematic perspective view from one side showing a bandpass filter 70 which is an example having the exciting electrodes formed on the third side surface of the dielectric block. FIG. 16 is a schematic perspective view from the opposite side showing the bandpass filter 70 of FIG. 15.

As shown in FIGS. 15 and 16, the bandpass filter 70 is constituted of a dielectric block 72 and various metal plates formed on the surface thereof The dielectric block 72 is made of dielectric material whose dielectric constant $\in_r$ is 37, for example, and has the same shape as the dielectric block 2 constituting the bandpass filter 1 of above-mentioned embodiment. Further, the dielectric block 72 is composed of a first portion lying between a first cross-section and a second cross-section parallel to the first cross-section and second and third portions divided by the first portion, similarly to the dielectric block 72.

Further, a metal plate 73 is formed on entire top surface of the dielectric block 72. A metal plate 76 is formed on the bottom surface of the dielectric block 72 except at clearance portions 74 and 75. As shown in FIG. 15, exciting electrodes 77 and 78 and a first inductive stub 79 are formed on the third side surface of the dielectric block 72 corresponding to a part of the second portion, a part of the third portion, and the entire first portion, respectively As shown in FIG. 16, a second inductive stub 80 is formed on the fourth side surface of the dielectric block 72 corresponding to the entire first portion.

The exciting electrodes 77 and 78 are prevented from being in contact with the metal plate 76 formed on the bottom surface of the dielectric block 72 by the clearance portions 74 and 75, respectively. Because the exciting electrodes 77 and 78 are formed at regions close to the first and second side surfaces, respectively, where the electric field is relatively strong, the exciting electrodes 77 and 78 can capacitively excite the bandpass filter 70, similarly to the bandpass filter 1 of the above-described embodiment.

The first and second inductive stubs 79 and 80 are connected to the metal plates 73 and 76 formed on the top and bottom surfaces of the dielectric block 72. The metal plate 76 is grounded.

No metal plate or electrode is formed on the remaining surfaces of the dielectric block 72, which therefore constitute open ends.

According to the above described structure, the first portion of the dielectric block 72 and the metal plate formed thereon act as an evanescent waveguide 81, the second portion of the dielectric block 72 and the metal plate formed thereon act as a first resonator 82, and the third portion of the dielectric block 72 and the metal plate formed thereon act as a second resonator 83. Because the bandpass filter 70 employs the first and second inductive stubs 79 and 80, a predetermined coupling occurs between the first resonator 82 and the second resonator 83 so that the resonator structure filter 70 acts as a bandpass filter having desired characteristics, similarly to the bandpass filter 1.

Since like the bandpass filter 50 the bandpass filter 70 does not require any metal plate or electrode to be formed on the first and second side surface of the dielectric block 72, the number of fabricating steps can be reduced compared with the bandpass filter 1.

Figure 17:
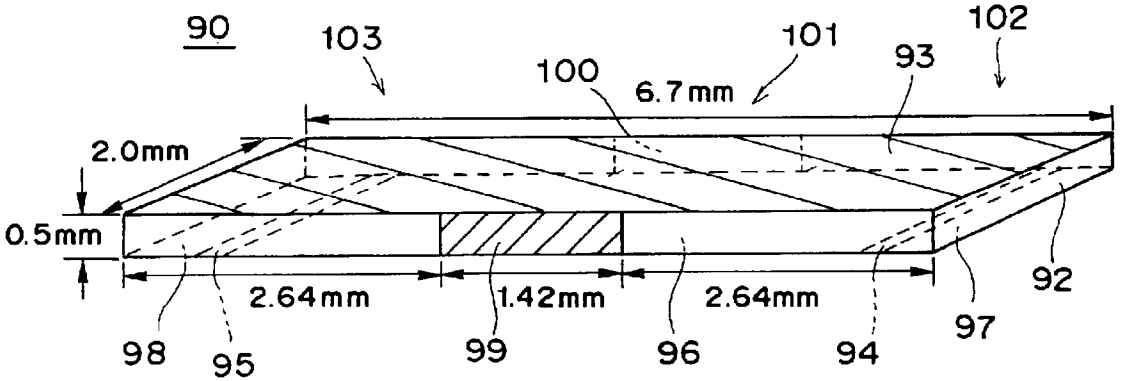
FIG. 17 is a schematic perspective view from the top side showing a bandpass filter 90 which is an example having the exciting electrodes formed on the bottom surface of the dielectric block.
Figure 18:
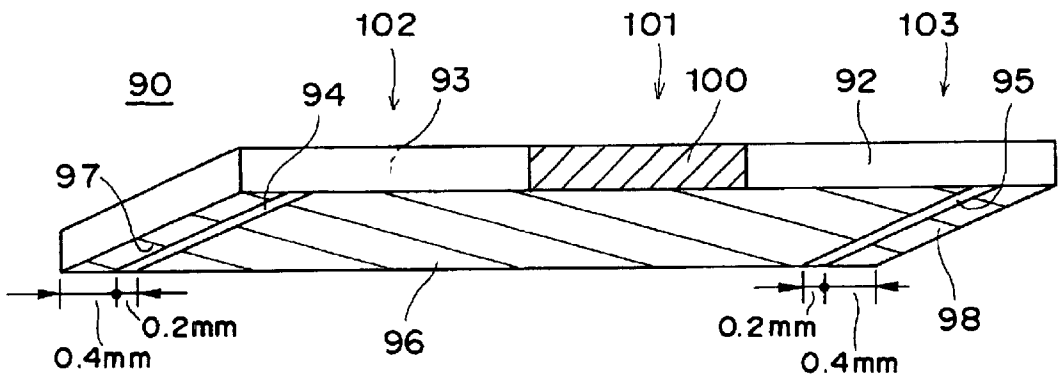
FIG. 18 is a schematic perspective view from the bottom side showing the bandpass filter 90 of FIG. 17.

FIG. 17 is a schematic perspective view from the top side showing a bandpass filter 90 which is an example having the exciting electrodes formed on the bottom surface of the dielectric block. FIG. 18 is a schematic perspective view from the bottom side showing the bandpass filter 90 of FIG. 17.

As shown in FIGS. 17 and 18, the bandpass filter 90 is constituted of a dielectric block 92 and various metal plates formed on the surface thereof. The dielectric block 92 is made of dielectric material whose dielectric constant $\in_r$ is 37, for example, and has the shape of a rectangular prism whose length, width, and thickness are 6.7 mm, 2.0 mm, and 0.5 mm. That is, the thickness of the dielectric block 92 is half the thickness of the dielectric block 92 constituting the bandpass filter 1 of the above-described embodiment. The dielectric block 92 is composed of a first portion lying between a first cross-section and a second cross-section parallel to the first cross-section and second and third portions divided by the first portion.

The first portion of the dielectric block 92, whose length, width, and thickness are 1.42 mm, 2.0 mm, and 0.5 mm, is located at the center of the rectangular prismatic dielectric block 92. The second and third portions of the dielectric block 92 are symmetrically located relative to the first portion. Each measures 2.64 mm, 2.0 mm, and 0.5 mm in length, width and thickness.

As shown in FIGS. 17 and 18, a metal plate 93 is formed on entire top surface of the dielectric block 92 and a metal plate 96 and exciting electrodes 97 and 98 are formed on the bottom surface of the dielectric block 92. The exciting electrode 97 and 98 are prevented from being in contact with the metal plate 96 formed on the bottom surface of the dielectric block 92 by the clearance portions 94 and 95, respectively. Further, a first inductive stub 99 is formed on the third side surface of the dielectric block 92 corresponding to the entire first portion and a second inductive stub 100 is formed on the fourth side surface of the dielectric block 92 corresponding to the entire first portion.

The exciting electrodes 97 and 98, each measuring 0.4 mm=2.0 mm as shown in FIG. 18, are formed at regions close to the first and second side surfaces, respectively, where the electric field is relatively strong. The widths of the clearance portions 94 and 95 are 0.2 mm. Because the exciting electrodes 97 and 98 are formed at regions where the electric field is relatively strong and are prevented from being in contact with the metal plate 96 by the clearance portions 94 and 95, the exciting electrodes 97 and 98 can capacitively excite the bandpass filter 90, similarly similar to the bandpass filter 1 of the above-described embodiment.

The first and second inductive stubs 99 and 100 are connected to the metal plates 93 and 96 formed on the top and bottom surfaces of the dielectric block 92. By this, the metal plate 93 and the metal plate 96 are connected by the first and second inductive stubs 99 and 100. The metal plate 96 is grounded.

No metal plate or electrode is formed on the remaining surfaces of the dielectric block 92, which therefore constitute open ends.

According to the above described structure, the first portion of the dielectric block 92 and the metal plate formed thereon act as an evanescent waveguide 101, the second portion of the dielectric block 92 and the metal plate formed thereon act as a first resonator 102, and the third portion of the dielectric block 92 and the metal plate formed thereon act as a second resonator 103. Because the bandpass filter 90 employs the first and second inductive stubs 99 and 100, a predetermined coupling occurs between the first resonator 102 and the second resonator 103 so that the resonator structure 90 acts as a bandpass filter having desired characteristics, similarly to the bandpass filter 1.

Figure 19:
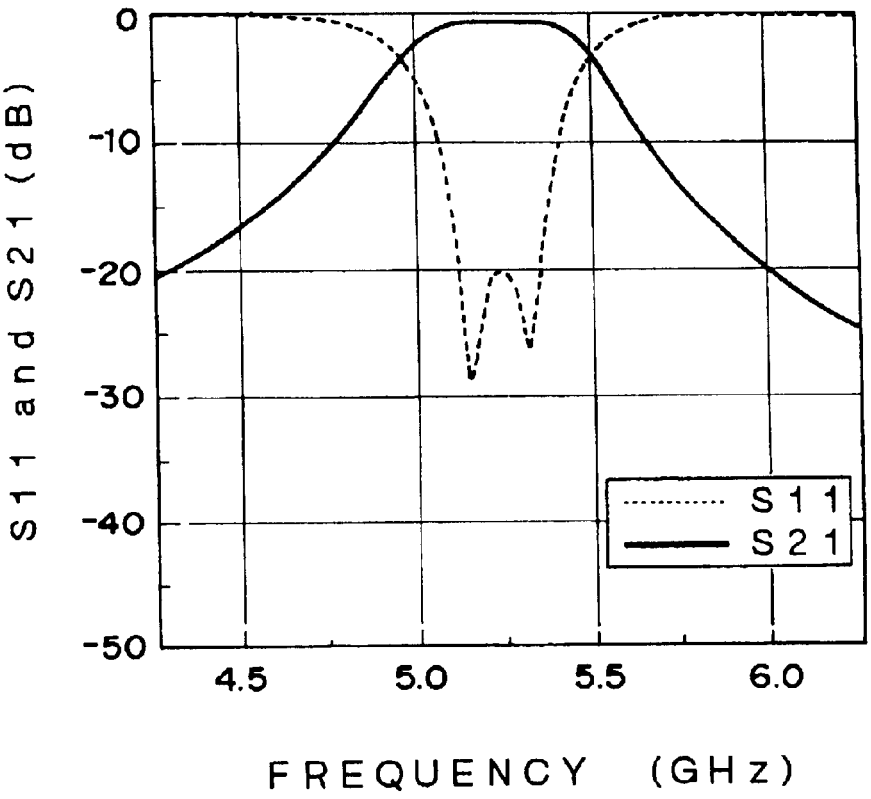
FIG. 19 is a graph showing the frequency characteristic curve of the bandpass filter 90 shown in FIGS. 17 and 18.

FIG. 19 is a graph showing the frequency characteristic curve of the bandpass filter 90.

In FIG. 19, S11 represents a reflection coefficient, and S21 represents a transmission coefficient. As shown in FIG. 19, the resonant frequency of the bandpass filter 90 is approximately 5.25 GHz and its 3-dB bandwidth is approximately 540 MHz. The insertion loss is approximately 0.8 dB. That is, substantially the same characteristics as the bandpass filter 1 can be obtained.

According to the bandpass filter 90, because the exciting electrodes 97 and 98 are formed on the bottom surface of the dielectric block 92, it is not necessary to form them on the side surface of the dielectric block 92 on which it is relatively difficult to form them compared with the top or bottom surfaces. For this reason, because the dielectric block 92 can be substantially thinned, the bandpass filter 90 can be preferably utilized in communication terminals that are required to be small, such as mobile phones.

Further, since like the bandpass filters 50 and 70 the bandpass filter 90 does not require any metal plate or electrode to be formed on the first and second side surface of the dielectric block 92, the number of fabricating steps can be reduced compared with the bandpass filter 1.

Figure 20:
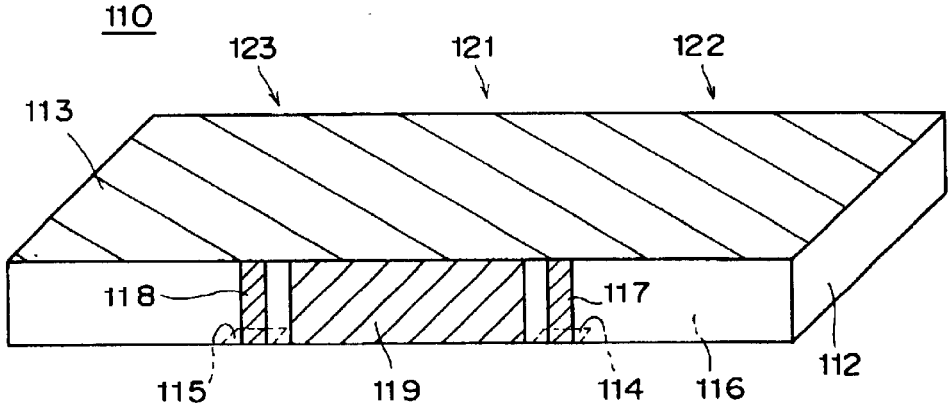
FIG. 20 is a schematic perspective view from one side showing a bandpass filter 110 which is an example having the inductive exciting electrodes formed on the third side surface of the dielectric block.
Figure 21:
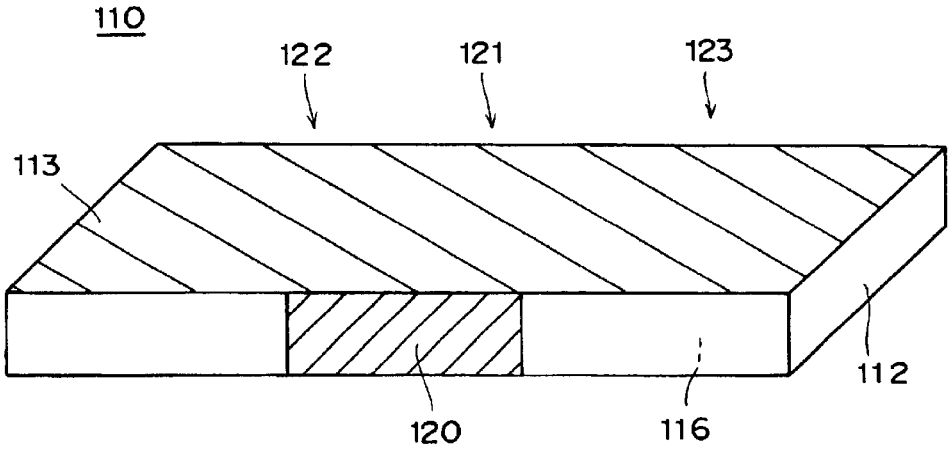
FIG. 21 is a schematic perspective view from the opposite side showing the bandpass filter 110 of FIG. 20.

FIG. 20 is a schematic perspective view from one side showing a bandpass filter 110 which is an example having the inductive exciting electrodes formed on the third side surface of the dielectric block. FIG. 21 is a schematic perspective view from the opposite side showing the bandpass filter 110 of FIG. 20.

As shown in FIGS. 20 and 21, the bandpass filter 110 is constituted of a dielectric block 112 and various metal plates formed on the surface thereof The dielectric block 112 is made of dielectric material whose dielectric constant $\in_r$ is 37, for example, and has the same shape as the dielectric block 112 constituting the bandpass filter 1 of above-mentioned embodiment. Further, the dielectric block 112 is composed of a first portion lying between a first cross-section and a second cross-section parallel to the first cross-section and second and third portions divided by the first portion similar to the dielectric block 112.

Further, a metal plate 113 is formed on entire top surface of the dielectric block 112. A metal plate 116 is formed on the bottom surface of the dielectric block 112 except at clearance portions 114 and 115. As shown in FIG. 20, an exciting electrodes 117 and 118 and a first inductive stub 119 are formed on the third side surface of the dielectric block 112 corresponding to a part of the second portion, a part of the third portion, and the entire first portion, respectively. As shown in FIG. 21, a second inductive stub 120 is formed on the fourth side surface of the dielectric block 112 corresponding to the entire first portion.

The exciting electrodes 117 and 118 are prevented from being in contact with the metal plate 116 formed on the bottom surface of the dielectric block 112 by the clearance portions 114 and 115, respectively, whereas the exciting electrodes 117 and 118 are in contact with the metal plate 113 formed on the top surface of the dielectric block 112. Because the exciting electrodes 117 and 118 are formed at regions close to the first portion where the magnetic field is relatively strong, the exciting electrodes 117 and 118 can inductively excite the bandpass filter 110, differently from the bandpass filter 1 of the above-described embodiment.

The first and second inductive stubs 119 and 120 are connected to the metal plates 113 and 116 formed on the top and bottom surfaces of the dielectric block 112. The metal plate 116 is grounded.

No metal plate or electrode is formed on the remaining surfaces of the dielectric block 112, which therefore constitute open ends.

According to the above described structure, the first portion of the dielectric block 112 and the metal plate formed thereon act as an evanescent waveguide 121, the second portion of the dielectric block 112 and the metal plate formed thereon act as a first resonator 122, and the third portion of the dielectric block 112 and the metal plate formed thereon act as a second resonator 123. Because the bandpass filter 110 employs the first and second inductive stubs 119 and 120, a predetermined coupling occurs between the first resonator 122 and the second resonator 123 so that the bandpass filter 110 acts as a bandpass filter having desired characteristics, similarly to the bandpass filter 1.

Further, since like the bandpass filters 50, 70 and 90 the bandpass filter 110 does not require any metal plate or electrode to be formed on the first and second side surface of the dielectric block 112, the number of fabricating steps can be reduced compared with the bandpass filter 1.

Figure 22:
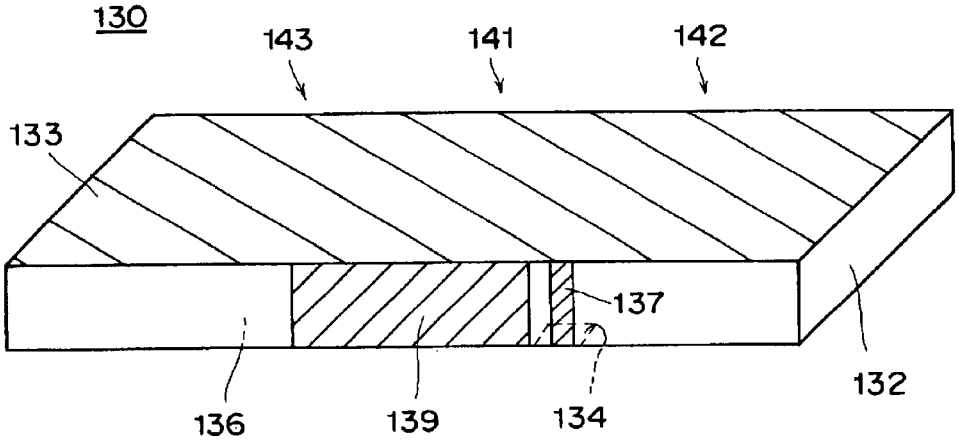
FIG. 22 is a schematic perspective view from one side showing a bandpass filter 130 which is an example having the inductive exciting electrodes formed on the third and fourth side surfaces of the dielectric block.
Figure 23:
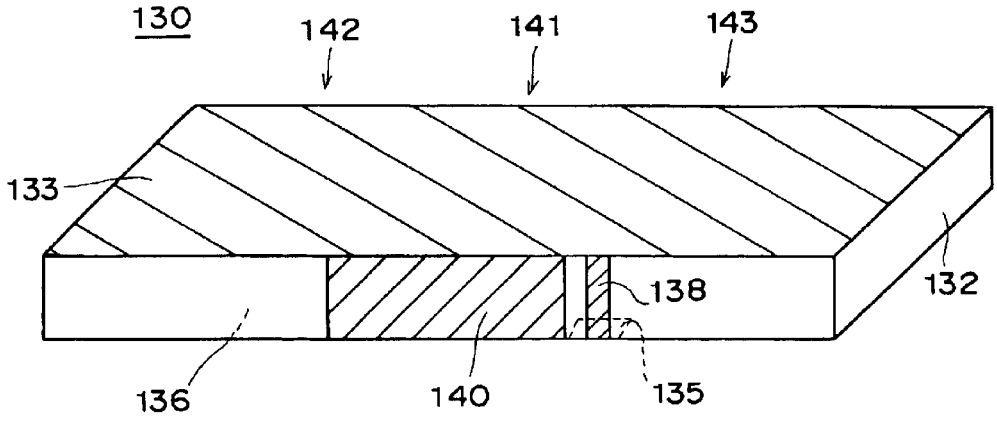
FIG. 23 is a schematic perspective view from the opposite side showing the bandpass filter 130 of FIG. 22.

FIG. 22 is a schematic perspective view from one side showing a bandpass filter 130 which is an example having the inductive exciting electrodes formed on the third and fourth side surfaces of the dielectric block. FIG. 23 is a schematic perspective view from the opposite side showing the bandpass filter 130 of FIG. 22.

As shown in FIGS. 22 and 23, the bandpass filter 130 is constituted of a dielectric block 132 and various metal plates formed on the surface thereof. The dielectric block 132 is made of dielectric material whose dielectric constant $\in_r$ is 37, for example, and has the same shape as the dielectric block 132 constituting the bandpass filter 1 of above-mentioned embodiment. Further, the dielectric block 132 is composed of a first portion lying between a first cross-section and a second cross-section parallel to the first cross-section and second and third portions divided by the first portion similar to the dielectric block 132.

Further, a metal plate 133 is formed on the entire top surface of the dielectric block 132. A metal plate 136 is formed on the bottom surface of the dielectric block 132 except at clearance portions 134 and 135. As shown in FIG. 22, an exciting electrode 137 and a first inductive stub 139 are formed on the third side surface of the dielectric block 132 corresponding to a part of the second portion and the entire first portion, respectively. As shown in FIG. 23, an exciting electrode 138 and a second inductive stub 140 are formed on the fourth side surface of the dielectric block 132 corresponding to a part of the third portion and the entire first portion.

The exciting electrodes 137 and 138 are prevented from being in contact with the metal plate 136 formed on the bottom surface of the dielectric block 132 by the clearance portions 134 and 135, respectively, whereas the exciting electrodes 137 and 138 are in contact with the metal plate 133 formed on the top surface of the dielectric block 132. Because the exciting electrodes 137 and 138 are formed at regions close to the first portion where the magnetic field is relatively strong, the exciting electrodes 137 and 138 can inductively excite the bandpass filter 130, similarly to the bandpass filter 110.

The first and second inductive stubs 139 and 140 are connected to the metal plates 133 and 136 formed on the top and bottom surfaces of the dielectric block 132. The metal plate 136 is grounded.

No metal plate or electrode is formed on the remaining surfaces of the dielectric block 132, which therefore constitute open ends.

According to the above described structure, the first portion of the dielectric block 132 and the metal plate formed thereon act as an evanescent waveguide 141, the second portion of the dielectric block 132 and the metal plate formed thereon act as a first resonator 142, and the third portion of the dielectric block 132 and the metal plate formed thereon act as a second resonator 143. Because the bandpass filter 130 employs the first and second inductive stubs 139 and 140, a predetermined coupling occurs between the first resonator 142 and the second resonator 143 so that the bandpass filter 130 acts as a bandpass filter having desired characteristics, similarly to the bandpass filter 1.

Further, since like the bandpass filters 50, 70, 90 and 110 the bandpass filter 130 does not require any metal plate or electrode to be formed on the first and second side surface of the dielectric block 112, the number of fabricating steps can be reduced compared with the bandpass filter 1.

Another preferred embodiment of the present invention will now be explained.

Figure 24:
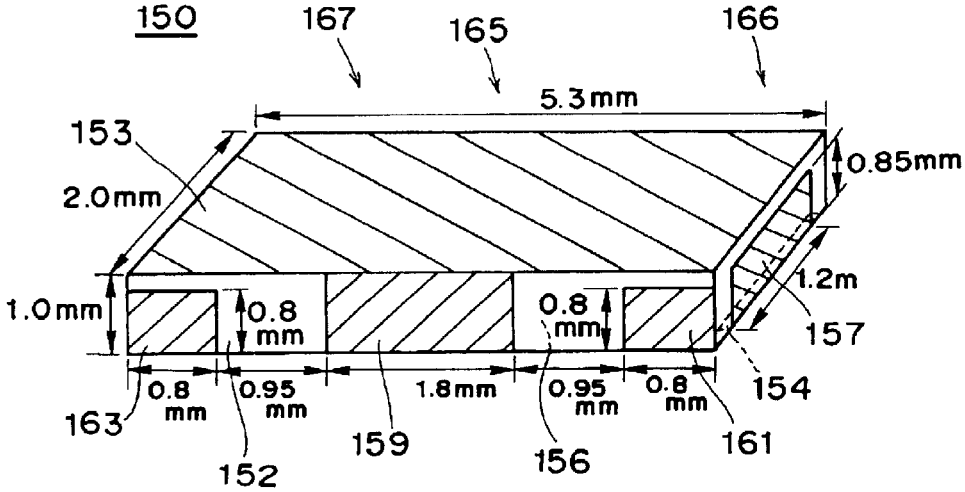
FIG. 24 is a schematic perspective view from one side showing a bandpass filter 150 that is another preferred embodiment of the present invention.
Figure 25:
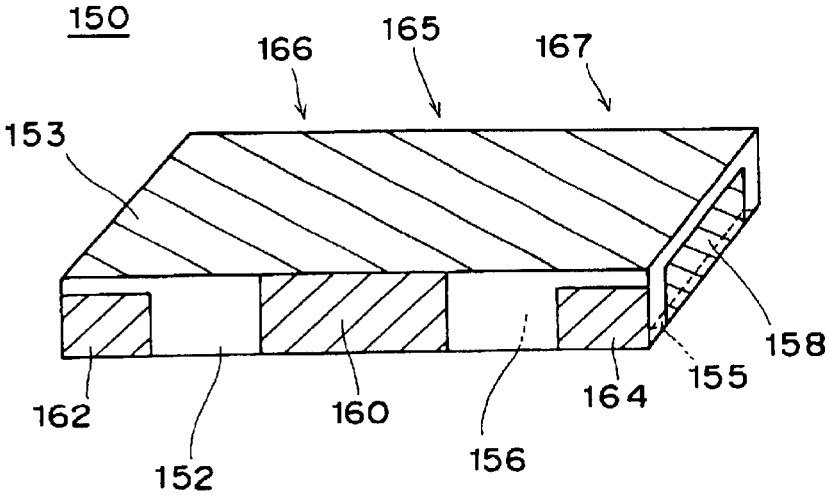
FIG. 25 is a schematic perspective view from the opposite side showing the bandpass filter 150 of FIG. 24.

FIG. 24 is a schematic perspective view from one side showing a bandpass filter 150 that is another preferred embodiment of the present invention. FIG. 25 is a schematic perspective view from the opposite side showing the bandpass filter 150 of FIG. 24.

As shown in FIGS. 24 and 25, the bandpass filter 150 that is another preferred embodiment of the present invention is constituted of a dielectric block 152 and various metal plates formed on the surface thereof. The dielectric block 152 is made of dielectric material whose dielectric constant $\in_r$ is 37, for example, and has the shape of a rectangular prism, whose length, width, and thickness are 5.3 mm, 2.0 mm, and 1.0 mm. That is, the dielectric block 152 has no holes or surface irregularities.

Further, the dielectric block 152 is composed of a first portion lying between a first cross-section and a second cross-section parallel to the first cross-section and second and third portions divided by the first portion. The first portion of the dielectric block 152, whose length, width, and thickness are 1.8 mm, 2.0 mm, and 1.0 mm, is located at the center of the rectangular prismatic dielectric block 152. The second and third portions of the dielectric block 152 are symmetrically located relative to the first portion. Each measures 1.75 mm, 2.0 mm, and 1.0 mm in length, width and thickness. Directions defining the "length," "width," and "thickness" are the same as those of the bandpass filter 1 of the above-described embodiment.

As shown in FIGS. 24 and 25, metal plate 153 is formed on entire top surface of the dielectric block 152. A metal plate 156 is formed on the bottom surface of the dielectric block 152 except at clearance portions 154 and 155.

As shown in FIG. 24, an exciting electrode 157, whose height and width are 0.85 mm and 1.2 mm, is formed on the first side surface of the dielectric block 152 where the clearance portion 154 prevents the exciting electrode 157 from being in contact with the metal plate 156 formed on the bottom surface. Similarly, as shown in FIG. 25, an exciting electrode 158, whose height and width are 0.85 mm and 1.2 mm, is formed on the second side surface of the dielectric block 152 where the clearance portion 155 prevents the exciting electrode 158 from being in contact with the metal plate 156 formed on the bottom surface. One of the exciting electrodes 157 and 158 is used as an input electrode, and the other is used as an output electrode.

As shown in FIGS. 24 and 25, a first inductive stub 159, whose height and width are 1.0 mm and 1.8 mm, is formed on the third side surface of the dielectric block 152 corresponding to the first portion and a second inductive stub 160, whose height and width are 1.0 mm and 1.8 mm, is formed on the fourth side surface of the dielectric block 152 corresponding to the first portion. The first and second inductive stubs 159 and 160 are connected to the metal plates 153 and 156 formed on the top and bottom surfaces of the dielectric block 152. The metal plate 156 is grounded.

Further, a first capacitive stub 161 is formed on the third side surface of the dielectric block 152 corresponding to the second portion, a second capacitive stub 162 is formed on the fourth side surface of the dielectric block 152 corresponding to the second portion, a third capacitive stub 163 is formed on the third side surface of the dielectric block 152 corresponding to the third portion, and a fourth capacitive stub 164 is formed on the fourth side surface of the dielectric block 152 corresponding to the third portion. The first to fourth capacitive stubs 161 to 164 measures 0.8 mm and 0.8 mm in height and width. The first to fourth capacitive stubs 161 to 164 are in contact with the metal plate 156 formed on the bottom surface.

The direction defining the "width" of the first and second inductive stubs 159 and 160 and the first to fourth capacitive stubs 161 to 164 is coincident with the direction defining the "length" of the dielectric block 152.

No metal plate or electrode is formed on the remaining surfaces of the dielectric block 152, which therefore constitute open ends.

According to the above described structure, the first portion of the dielectric block 152 and the metal plate formed thereon act as an evanescent waveguide 165, the second portion of the dielectric block 152 and the metal plate formed thereon act as a first resonator 166, and the third portion of the dielectric block 152 and the metal plate formed thereon act as a second resonator 167. The evanescent waveguide 165 is an H-mode waveguide, and each of the first and second resonators 166 and 167 is a quarter-wave (λ/4) dielectric resonator.

Figure 26:
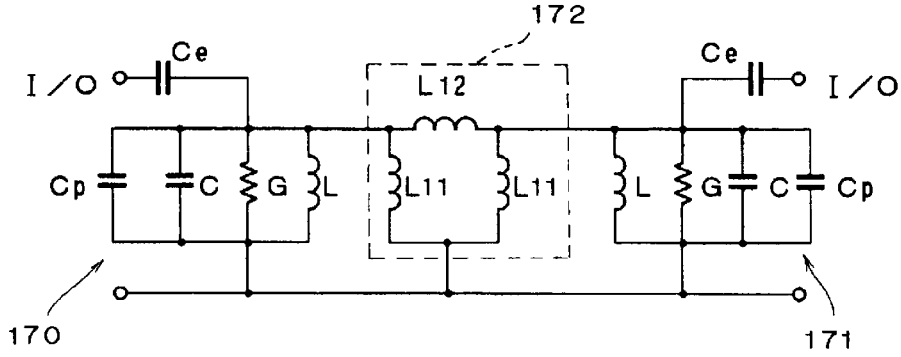
FIG. 26 is an equivalent circuit diagram of the bandpass filter 150 shown in FIGS. 24 and 25.

FIG. 26 is an equivalent circuit diagram of the bandpass filter 150 shown in FIGS. 24 and 25.

In this Figure, the first resonator 166 and the second resonator 167 are represented by two L-C parallel circuits 170 and 171, respectively. The conductance G represents the loss factor of each resonator. Two capacitancess Cp are produced by the first and second capacitive stubs 161 and 162 and the third and fourth capacitive stubs 163 and 164, respectively. The exciting electrodes 157 and 158 are represented by two capacitances Ce. The H-mode evanescent waveguide 165 is represented by the coupling inductance $L_{12}$ (internal coupling inductance) connected between the first resonator 166 and the second resonator 167 in series and a pair of shunt inductances $L_{11}$, which are grounded. That is, the evanescent waveguide 165 forms the π-type inductive circuit 172.

Figure 27:
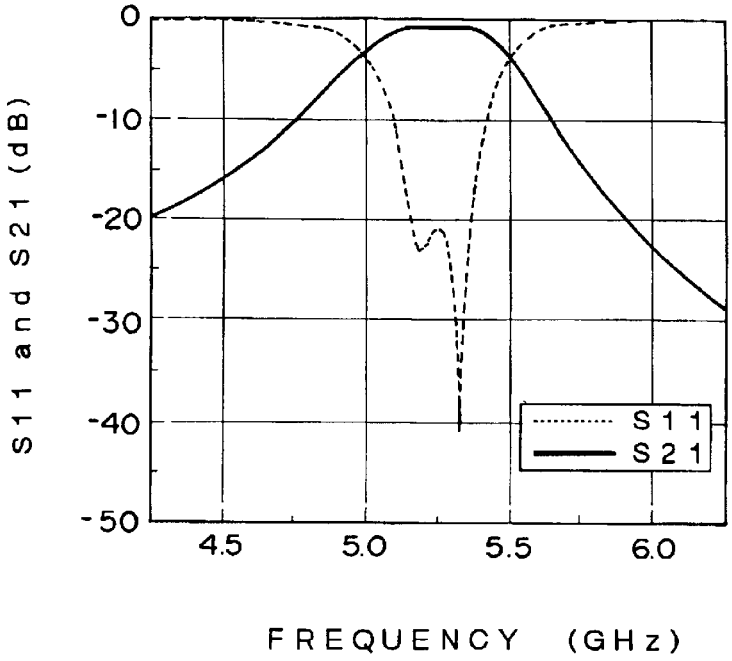
FIGS. 27 and 28 are graphs showing the frequency characteristic curve of the bandpass filter 150 shown in FIGS. 24 and 25.
Figure 28:
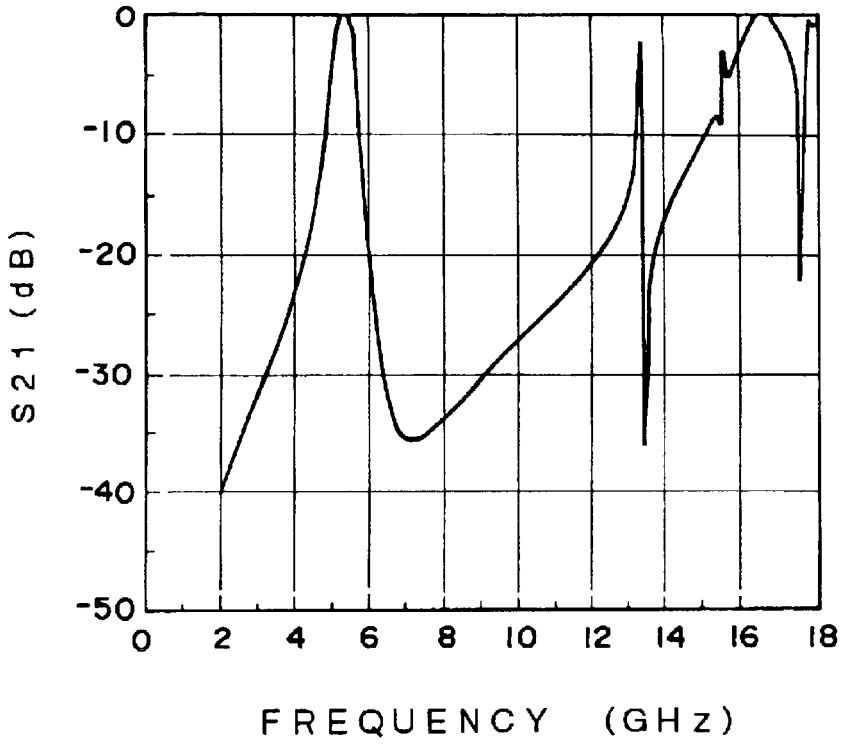

Both FIGS. 27 and 28 are graphs showing the frequency characteristic curve of the bandpass filter 150.

In FIGS. 27 and 28, S11 represents a reflection coefficient, and S21 represents a transmission coefficient. As shown in FIG. 27, the resonant frequency of the bandpass filter 150 is approximately 5.25 GHz and its 3-dB bandwidth is approximately 510 MHz. The insertion loss is approximately 0.7 dB. As shown in FIG. 28, the first spurious resonance frequency appears at more than 13 GHz, which is sufficiently far from the dominant frequency.

Next, functions of the first to fourth capacitive stubs 161 to 164 provided in the bandpass filter 150 will be explained.

Figure 29:
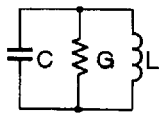
FIG. 29 is an equivalent circuit diagram of the quarter-wave ($\lambda/4$) dielectric resonator shown in FIG. 5.

FIG. 29 is an equivalent circuit diagram of the quarter-wave (λ/4) dielectric resonator shown in FIG. 5.

As shown in FIG. 5, the quarter-wave (λ/4) dielectric resonator can be represented by an L-C parallel circuit and its resonant frequency $f_1$ can be represented by the following formula. The conductance G represents the loss factor of the resonator.

$$f_1 = \frac{1}{2\pi\sqrt{LC}} \tag{5}$$

Figure 30:
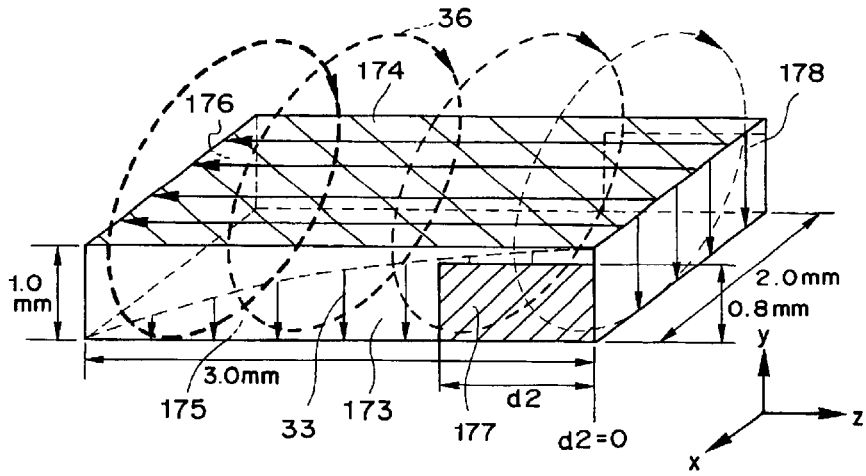
FIG. 30 is a schematic perspective view showing a model in which two capacitive stubs are added to the quarter-wave ($\lambda/4$) dielectric resonator shown in FIG. 5.

FIG. 30 is a schematic perspective view showing a model in which two capacitive stubs are added to the quarter-wave (λ/4) dielectric resonator shown in FIG. 5.

The model shown in FIG. 30 is constituted of a dielectric block 173, metal plates 174 and 175 formed on the top and bottom surfaces of the dielectric block 173, respectively, a metal plate 176 formed on one of the side surfaces of the dielectric block 173, and first and second capacitive stubs 177 and 178. The dielectric block 173 measures 3.0 mm, 2.0 mm and 1.0 mm in length, width and thickness. Among four side surfaces of the dielectric block 173, the side surface on which the metal plate 176 is formed is a short end (first side surface) where the electric field is minimum and the magnetic field is maximum. The side surface opposite to the short end is an open end (second side surface) where the electric field is maximum and the magnetic field is minimum. In FIG. 30, the strength of the magnetic field is represented by the thickness of the broken line 36.

The first capacitive stub 177 is formed on one side surface (third side surface) of the side surfaces perpendicular to the electric field having a height and width of 0.8 mm and d2 Similarly, the second capacitive stub 178 is formed on the other side surface (fourth side surface) of the side surfaces perpendicular to the electric field having height and width of 0.8 mm and d2. The line where d2=0 mm is coincident with the end of the third and fourth side surfaces on the side of the open end. In other words, the first and second capacitive stubs 177 and 178 are located at regions of the third and fourth side surface where the electric field is relatively strong. The first and second capacitive stubs 177 and 178 are in contact with the metal plate 175 formed on the bottom surface of the dielectric block 173.

Figure 31:
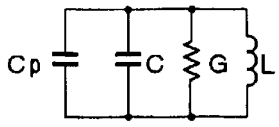
FIG. 31 is an equivalent circuit diagram of the model shown in FIG. 30.

FIG. 31 is an equivalent circuit diagram of the model shown in FIG. 30.

As shown in FIG. 31, the model shown in FIG. 30 can be represented by an L-C parallel circuit having a parallel capacitance Cp produced by the first and second capacitive stubs 177 and 178 and its resonant frequency $f_2$ can be represented by the following formula.

$$f_2 = \frac{1}{2\pi\sqrt{L(C + C_p)}} \tag{6}$$

As is apparent from a comparison of the formulas (5) and (6), the resonant frequency $f_2$ of the model shown in FIG. 30 is lowered by the capacitance Cp produced by the first and second capacitive stubs 177 and 178. This means that the length of the quarter-wave (λ/4) dielectric resonator having a desired resonant frequency can be shortened by adding the first and second capacitive stubs 177 and 178.

The unloaded quality factor ($Q_0$) of the model shown in FIG. 30 can be represented by the following formula.

$$Q_0 = \frac{2\pi f(C + C_p)}{G} \tag{7}$$

Figure 32:
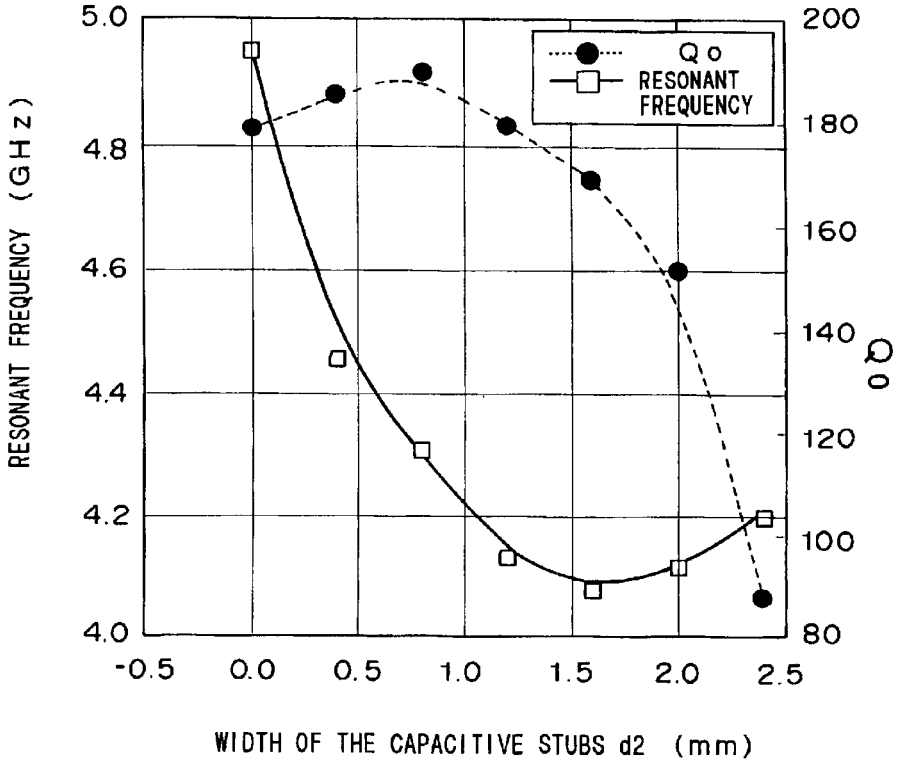
FIG. 32 is a graph showing the relationship between the width d2 of the first and second capacitive stubs 177 and 178 and a resonant frequency and an unloaded quality factor ($Q_0$).

FIG. 32 is a graph showing the relationship between the width d2 of the first and second capacitive stubs 177 and 178 and a resonant frequency and the unloaded quality factor ($Q_0$).

As is apparent from FIG. 32, the resonant frequency markedly decreases with increasing width d2 of the first and second capacitive stubs 177 and 178 in the region where the width d2 is in the range of 0 mm to approximately 1.6 mm and the resonant frequency slightly increases with increasing width d2 in the region where the width d2 exceeds approximately 1.6 mm. Further, as is apparent from FIG. 32, the unloaded quality factor ($Q_0$) does not much change at the region where the width d2 is in the range of 0 mm to approximately 1.6 mm and the unloaded quality factor ($Q_0$) markedly decreases with increasing width d2 in the region where the width d2 exceeds approximately 1.6 mm.

Especially, both low resonant frequency and good unloaded quality factor ($Q_0$) can be obtained in the region where the width d2 of the first and second capacitive stubs 177 and 178 is in the range of approximately 0.4 mm to approximately 1.6 mm. Therefore, in order to sufficiently lower the resonant frequency by adding the first and second capacitive stubs 177 and 178 while maintaining good unloaded quality factor ($Q_0$), it is preferable to set the width d2 of the first and second capacitive stubs 177 and 178 within the range of approximately 0.4 mm to approximately 1.6 mm. In the present invention, however, the width d2 of the first and second capacitive stubs 177 and 178 is not limited to the above range and the width d2 can be decided based on the desired resonant frequency, the desired length of the bandpass filter, and the desired unloaded quality factor ($Q_0$).

As is apparent from the foregoing, because the resonant frequency of the bandpass filter 150 of this embodiment is lowered compared with the original resonant frequency by adding the first to fourth capacitive stubs 161 to 164, substantially the same characteristics as the bandpass filter 1 can be obtained even if its length is approximately 21% shortened relative to the bandpass filter 1.

Thus, the bandpass filter 150 of this embodiment exhibits an effect of enabling overall size reduction owing to the provision of the first to fourth capacitive stubs 161 to 164 in addition to the same effects as the bandpass filter 1 of the above-described embodiment.

In the bandpass filter 150, although the capacitive exciting electrodes 157 and 158 are formed on the first and second side surfaces, respectively, inductive exciting electrodes can be used instead as explained with reference to FIGS. 20 to 23.

Further, although the bandpass filter 150 uses four capacitive stubs 161 to 164 to reduce overall size, the number of the capacitive stubs is not limited to four.

Figure 33:
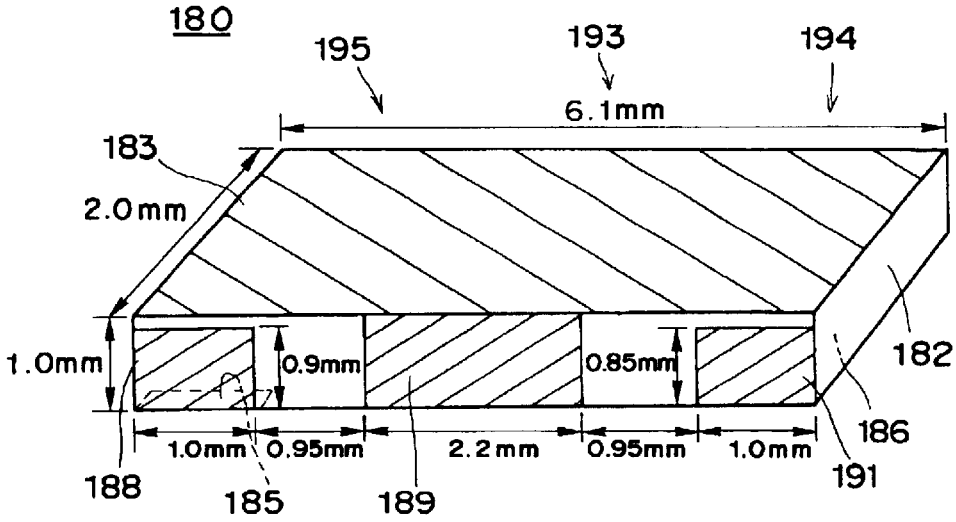
FIG. 33 is a schematic perspective view from one side showing a bandpass filter 180 which is an example having two capacitive stubs formed on the third and fourth side surfaces of a dielectric block, respectively.
Figure 34:
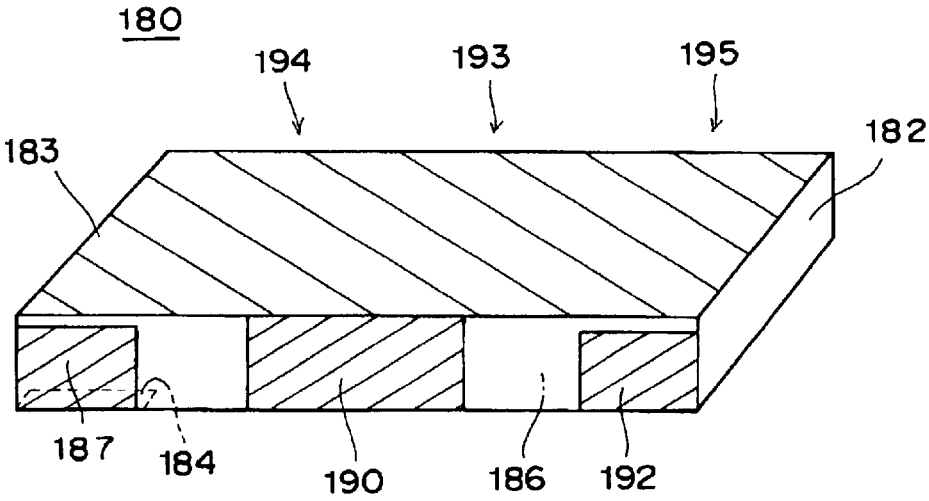
FIG. 34 is a schematic perspective view from the opposite side showing the bandpass filter 180 of FIG. 33.

FIG. 33 is a schematic perspective view from one side showing a bandpass filter 180 which is an example having two capacitive stubs formed on the third and fourth side surfaces of a dielectric block, respectively. FIG. 34 is a schematic perspective view from the opposite side showing the bandpass filter 180 of FIG. 33.

As shown in FIGS. 33 and 34, the bandpass filter 180 is constituted of a dielectric block 182 and various metal plates formed on the surface thereof The dielectric block 182 is made of dielectric material whose dielectric constant $\in_r$ is 37, for example, and has the shape of a rectangular prism whose length, width, and thickness are 6.1 mm, 2.0 mm, and 1.0 mm. Further, the dielectric block 182 is composed of a first portion lying between a first cross-section and a second cross-section parallel to the first cross-section and second and third portions divided by the first portion.

The first portion of the dielectric block 182, whose length, width, and thickness are 2.2 mm, 2.0 mm, and 1.0 mm, is located at the center of the rectangular prismatic dielectric block 182. The second and third portions of the dielectric block 182 are symmetrically located relative to the first portion. Each measures 1.95 mm, 2.0 mm, and 1.0 mm in length, width and thickness.

As shown in FIGS. 33 and 34, a metal plate 183 is formed on the entire top surface of the dielectric block 182. A metal plate 186 is formed on the bottom surface of the dielectric block 182 except at clearance portions 184 and 185. As shown in FIG. 33, a first inductive stub 189, a first capacitive stub 191, and an exciting electrode 188 are formed on the third side surface of the dielectric block 182 corresponding to the entire first portion, a part of the second portion and a part of the third portion, respectively. Similarly, as shown in FIG. 34, a second inductive stub 190, an exciting electrode 187, and a second capacitive stub 192 are formed on the fourth side surface of the dielectric block 182 corresponding to the entire first portion, a part of the second portion and a part of the third portion, respectively.

The exciting electrode 188, whose height and width are 0.9 mm and 1.0 mm, is formed on the third side surface of the dielectric block 182 at a region close to the second side surface where the electric field is relatively strong. Similarly, the exciting electrode 187, whose height and width are 0.9 mm and 1.0 mm, is formed on the fourth side surface of the dielectric block 182 at a region close to the first side surface where the electric field is relatively strong. Thus, similarly to what was explained regarding the bandpass filter 150 of the above-described embodiment, the exciting electrodes 187 and 188 can capacitively excite the bandpass filter 180.

The first and second inductive stubs 189 and 190 are connected to the metal plates 183 and 186 formed on the top and bottom surfaces of the dielectric block 182. By this, the metal plate 183 and the metal plate 186 are short-circuited by the first and second inductive stubs 189 and 190. These metal plates 183 and 186 are grounded.

Further, the first capacitive stub 191, whose height and width are 0.85 mm and 1.0 mm, is formed on the third side surface of the dielectric block 182 at a region close to the first side surface where the electric field is relatively strong. Similarly, the second capacitive stub 192, whose height and width are 0.85 mm and 1.0 mm, is formed on the fourth side surface of the dielectric block 182 at a region close to the second side surface where the electric field is relatively strong. The first and second capacitive stubs 191 and 192 are in contact with the metal plate 186 formed on the bottom surface.

No metal plate or electrode is formed on the remaining surfaces of the dielectric block 182, which therefore constitute open ends.

According to the above described structure, the first portion of the dielectric block 182 and the metal plate formed thereon act as an evanescent waveguide 193, the second portion of the dielectric block 182 and the metal plate formed thereon act as a first resonator 194, and the third portion of the dielectric block 182 and the metal plate formed thereon act as a second resonator 195. Because the bandpass filter 180 employs the first and second inductive stubs 189 and 190, a predetermined coupling occurs between the first resonator 194 and the second resonator 195 so that the bandpass filter 180 acts as a bandpass filter having desired characteristics, similarly to the bandpass filters 1 and 150.

Further, according to the bandpass filter 180, the resonant frequency of the first and second resonators 194 and 195 is lowered owing to the first and second capacitive stubs 191 and 192.

Figure 35:
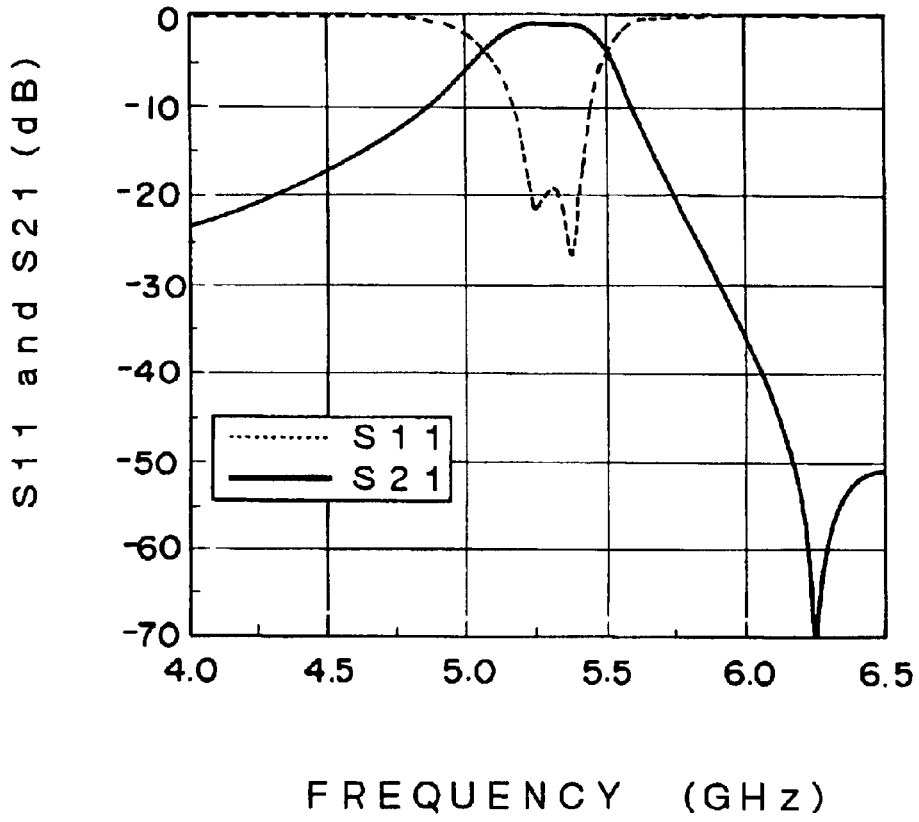
FIG. 35 is a graph showing the frequency characteristic curve of the bandpass filter 180 shown in FIGS. 33 and 34.

FIG. 35 is a graph showing the frequency characteristic curve of the bandpass filter 180.

In FIG. 35, S11 represents a reflection coefficient, and S21 represents a transmission coefficient. As shown in FIG. 35, the resonant frequency of the bandpass filter 180 is approximately 5.25 GHz and its 3-dB bandwidth is approximately 420 MHz. The insertion loss is approximately 0.9 dB. Further, an attenuation pole appears at approximately 6.25 GHz so that the higher edge of the passing band of the frequency characteristics is sharpened compared with the lower edge of the passing band.

As described above, according to the bandpass filter 180, substantially the same characteristics as the bandpass filter 1 can be obtained even if its length is approximately 9% shortened relative to the bandpass filter 1 by the function of the first and second capacitive stubs 191 and 192.

Further, according to the bandpass filter 180, because it is not necessary to form any metal plate or electrode on the first and second side surfaces of the dielectric block 182, the number of fabricating steps can be reduced compared with the bandpass filter 150.

In the bandpass filter 180, the inductive exciting electrodes can be used instead of the capacitive exciting electrodes 187 and 188 as explained with reference to FIGS. 20 to 23. In order to enhance the function of the capacitive stubs, further capacitive stubs can be formed on the first and second side surfaces of the dielectric block 182.

Figure 36:
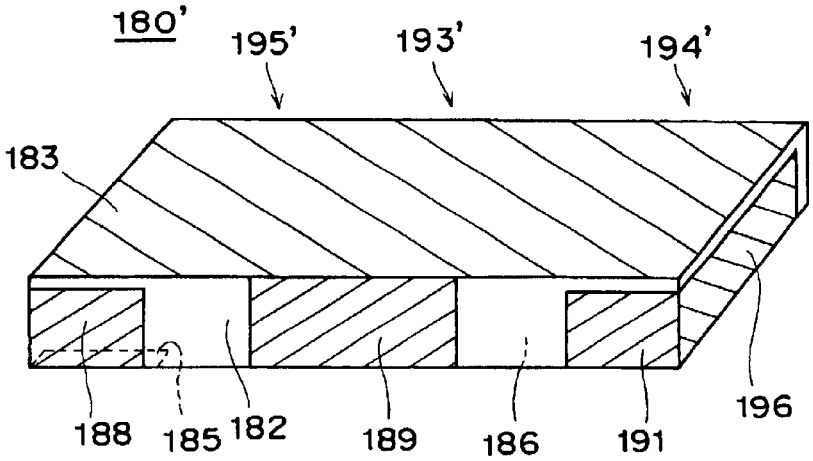
FIG. 36 is a schematic perspective view from one side showing a bandpass filter 180' which is an example having the third and fourth capacitive stubs added to the bandpass filter 180.
Figure 37:
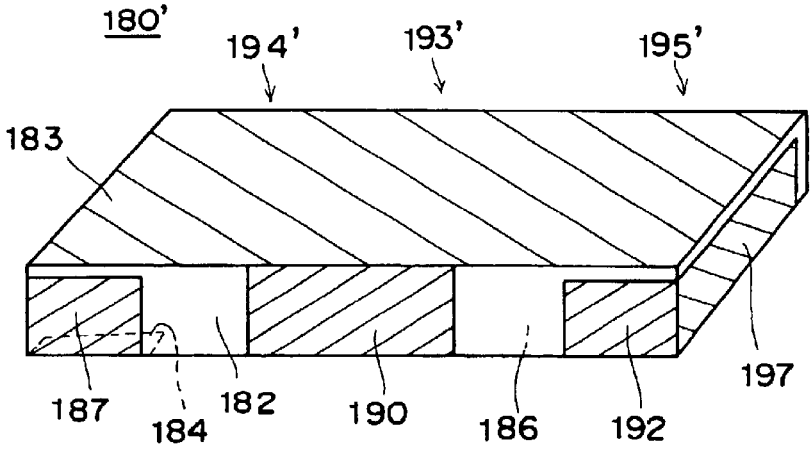
FIG. 37 is a schematic perspective view from the opposite side showing the bandpass filter 180' of FIG. 36.

FIG. 36 is a schematic perspective view from one side showing a bandpass filter 180' which is an example having the third and fourth capacitive stubs added to the bandpass filter 180. FIG. 37 is a schematic perspective view from the opposite side showing the bandpass filter 180' of FIG. 36.

As shown in FIGS. 36 and 37, the bandpass filter 180' differs from the bandpass filter 180 in that it is added with the third capacitive stub 196 formed on the first side surface of the dielectric block 182 and the fourth capacitive stub 197 formed on the second side surface of the dielectric block 182. The third capacitive stub 196 is in contact with the metal plate 186 formed on the bottom surface and the first capacitive stub 191 so that the first and third capacitive stubs 191 and 196 constitute L-shaped capacitive stubs. Similarly, the fourth capacitive stub 197 is in contact with the metal plate 186 formed on the bottom surface and the second capacitive stub 192 so that the second and fourth capacitive stubs 192 and 197 also constitute L-shaped capacitive stubs.

As explained earlier, the electric field is maximum at the first and second side surfaces of the dielectric block 182. Therefore, the effect of the capacitive stubs can be obtained more strongly by adding the third and fourth capacitive stubs 196 and 197 on the first and second side surfaces.

Also in the bandpass filter 180', inductive exciting electrodes can be used instead of the capacitive exciting electrodes 187 and 188 as explained with reference to FIGS. 20 to 23.

Figure 38:
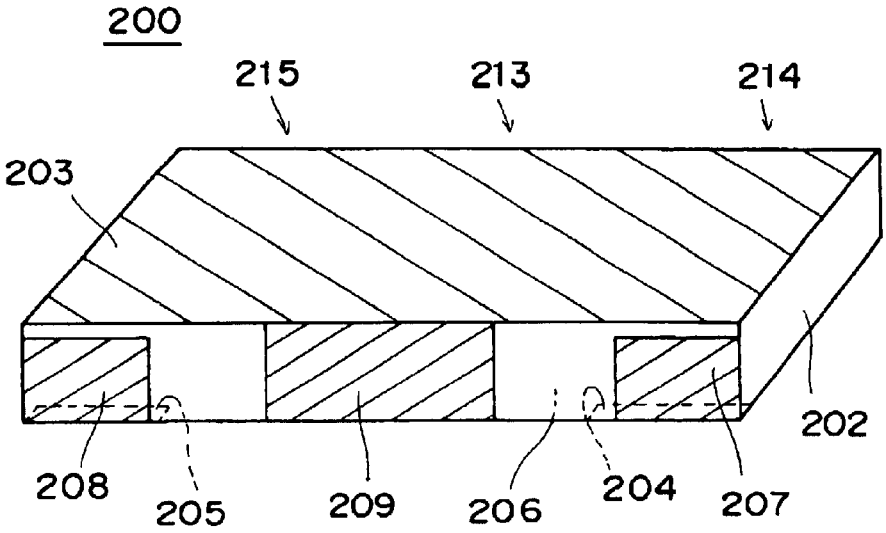
FIG. 38 is a schematic perspective view from one side showing a bandpass filter 200 which is an example having both capacitive stubs formed on the fourth side surface of a dielectric block.
Figure 39:
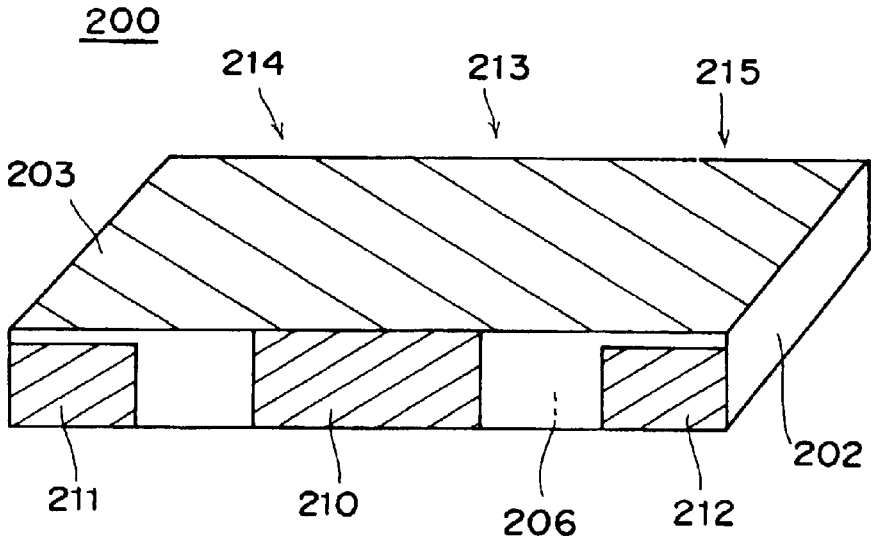
FIG. 39 is a schematic perspective view from the opposite side snowing the bandpass filter 200 of FIG. 38.

FIG. 38 is a schematic perspective view from one side showing a bandpass filter 200 which is an example having two capacitive stubs formed on the fourth side surface of a dielectric block. FIG. 39 is a schematic perspective view from the opposite side showing the bandpass filter 200 of FIG. 38.

As shown in FIGS. 38 and 39, the bandpass filter 200 is constituted of a dielectric block 202 and various metal plates formed on the surface thereof. The dielectric block 202 is made of dielectric material whose dielectric constant $\in_r$ is 37, for example, and has the same shape as the dielectric block 182 constituting the bandpass filter 180. Further, the dielectric block 182 is composed of a first portion lying between a first cross-section and a second cross-section parallel to the first cross-section and second and third portions divided by the first portion.

Further, a metal plate 203 is formed on the entire top surface of the dielectric block 202. A metal plate 206 is formed on the bottom surface of the dielectric block 202 except at clearance portions 204 and 205. As shown in FIG. 38, a first inductive stub 209 and exciting electrodes 207 and 208 are formed on the third side surface of the dielectric block 202 corresponding to the entire first portion, a part of the second portion, and a part of the third portion, respectively. The exciting electrodes 207 and 208 are prevented from being in contact with the metal plate 206 formed on the bottom surface of the dielectric block 202 by the clearance portions 204 and 205, respectively. Further, as shown in FIG. 39, a second inductive stub 210 and first and second capacitive stubs 211 and 212 are formed on the fourth side surface of the dielectric block 202 corresponding to the entire first portion, a part of the second portion, and a part of the third portion, respectively.

Because the exciting electrodes 207 and 208 are formed on the third side surface of the dielectric block 202 at regions close to the first and second side surfaces, respectively, where the electric field is relatively strong, the exciting electrodes 207 and 208 can capacitively excite the bandpass filter 200, similarly to what was explained regarding the bandpass filter 150 of the above-described embodiment.

The first and second inductive stubs 209 and 210 are connected to the metal plates 203 and 206 formed on the top and bottom surfaces of the dielectric block 202. By this, the metal plate 203 and the metal plate 206 are short-circuited by the first and second inductive stubs 209 and 210. These metal plates 203 and 206 are grounded.

Further, the first and second capacitive stubs 211 and 212 are formed on the fourth side surface of the dielectric block 202 at a region close to the first and second side surfaces, respectively, where the electric field is relatively strong. The first and second capacitive stubs 211 and 212 are in contact with the metal plate 206 formed on the bottom surface.

No metal plate or electrode is formed on the remaining surfaces of the dielectric block 202, which therefore constitute open ends.

According to the above described structure, the first portion of the dielectric block 202 and the metal plate formed thereon act as an evanescent waveguide 213, the second portion of the dielectric block 202 and the metal plate formed thereon act as a first resonator 214, and the third portion of the dielectric block 202 and the metal plate formed thereon act as a second resonator 215. Because the bandpass filter 200 employs the first and second inductive stubs 209 and 210, a predetermined coupling occurs between the first resonator 214 and the second resonator 215 so that the bandpass filter 200 acts as a bandpass filter having desired characteristics, similarly to the bandpass filters 1 and 150.

Further, in the bandpass filter 200, because the resonant frequency of the first and second resonators 214 and 215 is lowered owing to the first and second capacitive stubs 211 and 212, substantially the same characteristics as the bandpass filter 1 can be obtained even if its length is shortened relative to the bandpass filter 1.

Further, according to the bandpass filter 200, because it is not necessary to form any metal plate or electrode on the first and second side surface of the dielectric block 202, the number of fabricating steps can be reduced compared with the bandpass filter 150.

In the bandpass filter 200, inductive exciting electrodes can be used instead of the capacitive exciting electrodes 207 and 208 as explained with reference to FIGS. 20 to 23. In order to enhance the function of the capacitive stubs, further capacitive stubs can be formed on the first and second side surfaces of the dielectric block 202.

Figure 40:
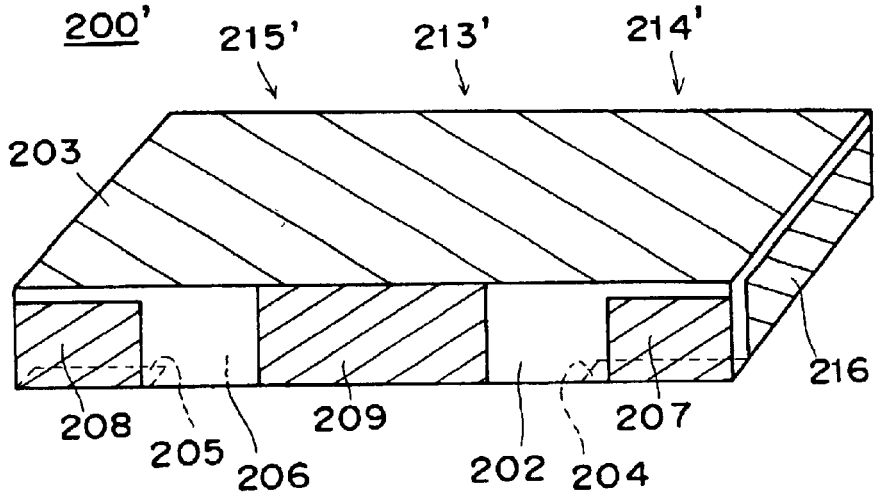
FIG. 40 is a schematic perspective view from one side showing a bandpass filter 200' which is an example having the third and fourth capacitive stubs added to the bandpass filter 200.
Figure 41:
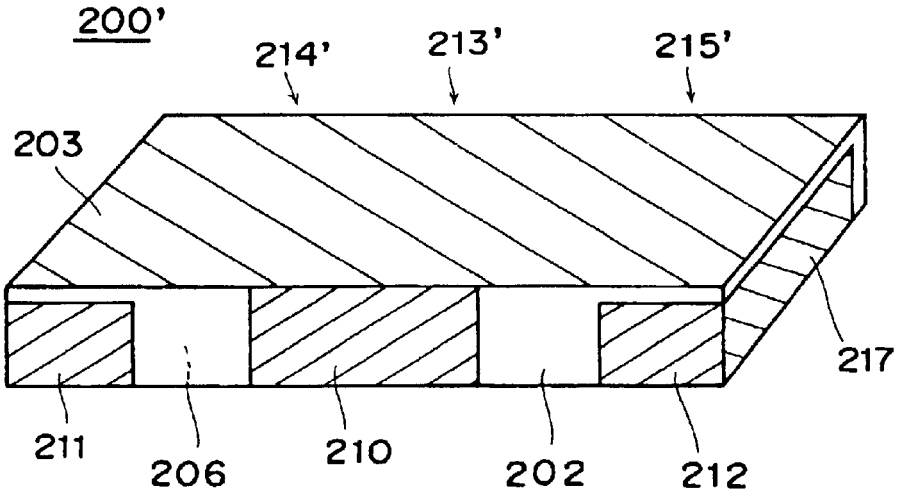
FIG. 41 is a schematic perspective view from the opposite side showing the bandpass filter 200' of FIG. 40.

FIG. 40 is a schematic perspective view from one side showing a bandpass filter 200' which is an example having the third and fourth capacitive stubs added to the bandpass filter 200. FIG. 41 is a schematic perspective view from the opposite side showing the bandpass filter 200' of FIG. 40.

As shown in FIGS. 40 and 41, the bandpass filter 200' differs in that the third capacitive stub 216 formed on the first side surface of the dielectric block 202 and the fourth capacitive stub 217 formed on the second side surface of the dielectric block 202 are added from the bandpass filter 200. The third capacitive stub 216 is in contact with the metal plate 206 formed on the bottom surface and the first capacitive stub 211 so that the first and third capacitive stubs 211 and 216 constitutes an L-shaped capacitive stub. Similarly, the fourth capacitive stub 217 is in contact with the metal plate 206 formed on the bottom surface and the second capacitive stub 212 so that the second and fourth capacitive stubs 212 and 217 also constitutes an L-shaped capacitive stub. According to the bandpass filter 200', because the third and fourth capacitive stubs 216 and 217 are added, the effect of the capacitive stubs can be obtained more strongly.

Also in the bandpass filter 200', inductive exciting electrodes can be used instead of the capacitive exciting electrodes 207 and 208 as explained with reference to FIGS. 20 to 23.

Figure 42:
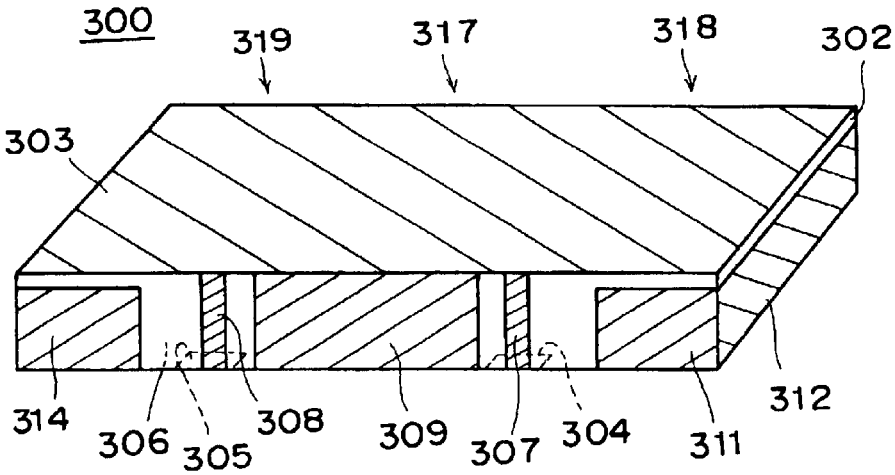
FIG. 42 is a schematic perspective view from one side showing a bandpass filter 300 which is an example having six capacitive stubs formed on the first to fourth side surface of a dielectric block.
Figure 43:
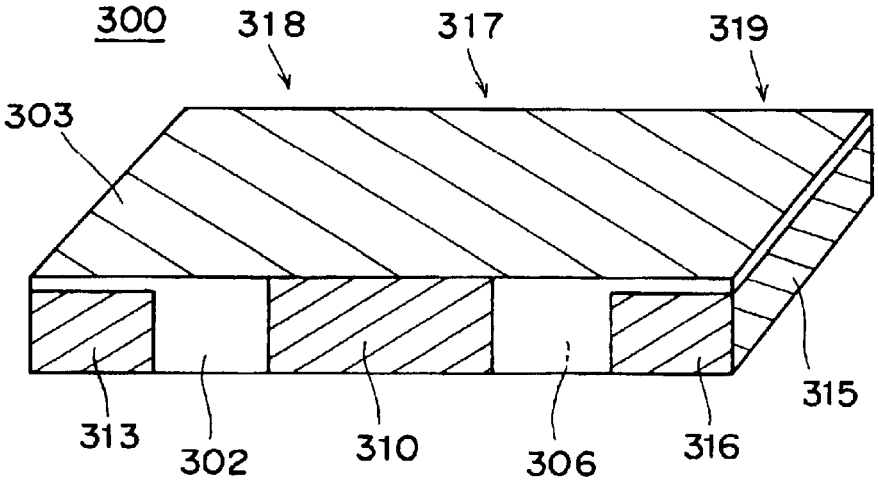
FIG. 43 is a schematic perspective view from the opposite side showing the bandpass filter 300 of FIG. 42.

FIG. 42 is a schematic perspective view from one side showing a bandpass filter 300 which is an example having six capacitive stubs formed on the first to fourth side surfaces of a dielectric block. FIG. 43 is a schematic perspective view from the opposite side showing the bandpass filter 300 of FIG. 42.

As shown in FIGS. 42 and 43, the bandpass filter 300 is constituted of a dielectric block 302 and various metal plates formed on the surface thereof The dielectric block 302 is made of dielectric material whose dielectric constant $\in_r$ is 37, for example, and is composed of a first portion lying between a first cross-section and a second cross-section parallel to the first cross-section and second and third portions divided by the first portion.

Further, a metal plate 303 is formed on entire top surface of the dielectric block 302. A metal plate 306 is formed on the bottom surface of the dielectric block 302 except at clearance portions 304 and 305. As shown in FIG. 42, a first inductive stub 309 and exciting electrodes 307 and 308 are formed on the third side surface of the dielectric block 302 corresponding to the entire first portion, a part of the second portion, and a part of the third portion, respectively. The exciting electrodes 307 and 308 are prevented from being in contact with the metal plate 306 formed on the bottom surface of the dielectric block 302 by the clearance portions 304 and 305, respectively, whereas the exciting electrodes 307 and 308 are in contact with the metal plate 303 formed on the top surface of the dielectric block 302. Because the exciting electrodes 307 and 308 are formed on the third side surface of the dielectric block 302 at regions close to the first portion where the magnetic field is relatively strong, the exciting electrodes 307 and 308 can inductively excite the bandpass filter 300.

Further, a first capacitive stub 311 is formed on the third side surface of the dielectric block 302 corresponding to the second portion, a second capacitive stub 312 is formed on the first side surface of the dielectric block 302, a third capacitive stub 313 is formed on the fourth side surface of the dielectric block 302 corresponding to the second portion, a fourth capacitive stub 314 is formed on the third side surface of the dielectric block 302 corresponding to the third portion, a fifth capacitive stub 315 is formed on the second side surface of the dielectric block 302, and a sixth capacitive stub 316 is formed on the fourth side surface of the dielectric block 302 corresponding to the third portion.

The first and second inductive stubs 309 and 310 are connected to the metal plates 303 and 306 formed on the top and bottom surfaces of the dielectric block 302. By this, the metal plate 303 and the metal plate 306 are short-circuited by the first and second inductive stubs 309 and 310. These metal plates 303 and 306 are grounded. Further, the first to third capacitive stubs 311 to 313 are formed on the dielectric block 302 at regions where the electric field is relatively strong in one direction; the fourth to sixth capacitive stubs 314 to 316 are formed on the dielectric block 302 at regions where the electric field is relatively strong in the other direction. The first to sixth capacitive stubs 311 and 316 are in contact with the metal plate 306 formed on the bottom surface.

According to the above described structure, the first portion of the dielectric block 302 and the metal plate formed thereon act as an evanescent waveguide 317, the second portion of the dielectric block 302 and the metal plate formed thereon act as a first resonator 318, and the third portion of the dielectric block 302 and the metal plate formed thereon act as a second resonator 319. Because the bandpass filter 300 employs the first and second inductive stubs 309 and 310, a predetermined coupling occurs between the first resonator 318 and the second resonator 319 so that the bandpass filter 300 acts as a bandpass filter having desired characteristics, similarly to the bandpass filters 1 and 150.

Further, in the bandpass filter 300, the resonant frequency of the first and second resonators 318 and 319 is lowered owing to the first to sixth capacitive stubs 311 to 316. Especially, in the bandpass filter 300, the effect of the capacitive stubs can be obtained more strongly because many capacitive stubs are employed. Therefore, substantially the same characteristics as the bandpass filter 1 can be obtained even if its length is shortened relative to the bandpass filter 1.

Another preferred embodiment of the present invention will now be explained.

Figure 44:
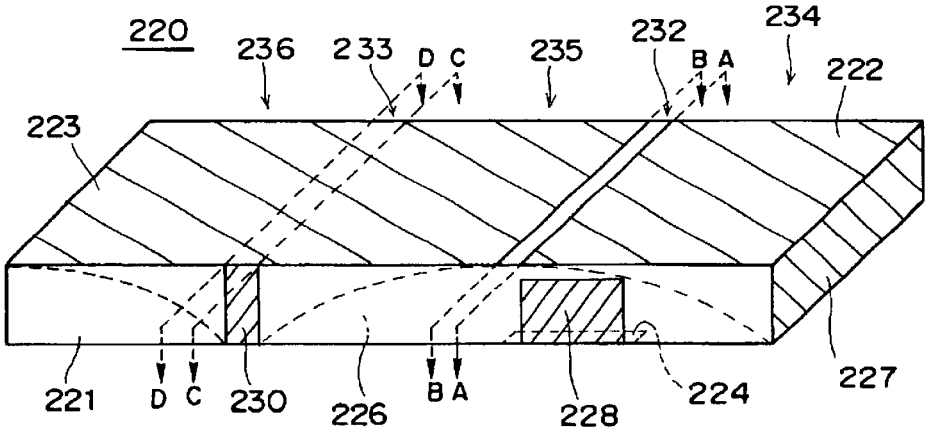
FIG. 44 is a schematic perspective view from one side showing a bandpass filter 220 that is still another preferred embodiment of the present invention.
Figure 45:
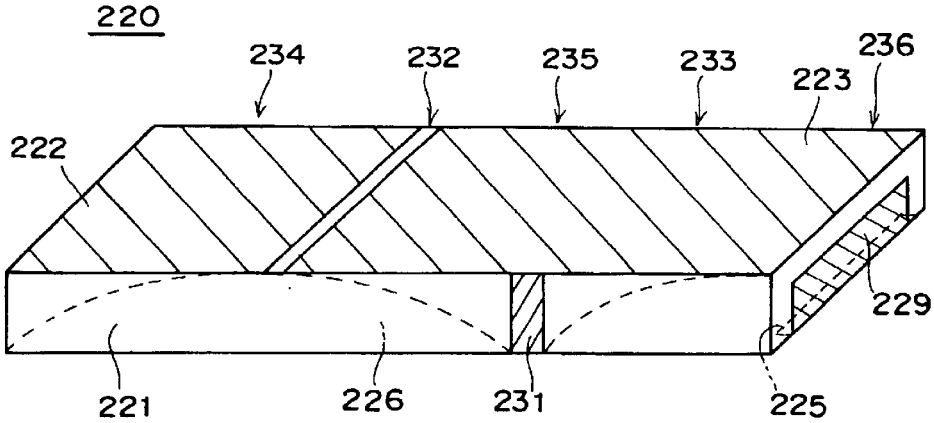
FIG. 45 is a schematic perspective view from the opposite side showing the bandpass filter 220 of FIG. 44.

FIG. 44 is a schematic perspective view from one side showing a bandpass filter 220 that is still another preferred embodiment of the present invention. FIG. 45 is a schematic perspective view from the opposite side showing the bandpass filter 220 of FIG. 44.

As shown in FIGS. 44 and 45, the bandpass filter 220 is constituted of a dielectric block 221 and various metal plates formed on the surface thereof The dielectric block 221 is made of dielectric material whose dielectric constant $\in_r$ is 37, for example, and has the shape of a rectangular prism. That is, the dielectric block 221 has no holes or surface irregularities.

The dielectric block 221 is composed of a first portion lying between an A—A cross-section (first cross-section) and a B—B cross-section (second cross-section) parallel to the first cross-section, a second portion lying between an C—C cross-section (third cross-section) and a D—D cross-section (fourth cross-section) parallel to the third cross-section, a third portion lying between the first side surface and the A—A cross-section (first cross-section), a fourth portion lying between the B—B cross-section (second cross-section) and a C—C cross-section (third cross-section), and a fifth portion lying between the second side surface and the D—D cross-section (fourth cross-section). Details will be explained later but the first and second portions constitute a part of first and second evanescent waveguides, respectively, and the third to fifth portions constitute a part of first to third resonators, respectively.

The definitions of the top surface, bottom surface, and first to fourth side surfaces of the dielectric block 221 are the same as those of the dielectric block 2.

As shown in FIGS. 44 and 45, a metal plate 222 is formed on the top surface of the dielectric block 221 corresponding to the third portion and a metal plate 223 is formed on the top surface of the dielectric block 221 corresponding to the second, fourth and fifth portions. A metal plate 226 is formed on the bottom surface of the dielectric block 221 except at clearance portions 224 and 225. Further, a metal plate 227 is formed on the entire first side surface of the dielectric block 221. The metal plate 227 is in contact with the metal plates 222 and 226 to short-circuit them.

Further, an exciting electrode 228 is formed on the third side surface of the dielectric block 221 corresponding to the third portion where the clearance portion 224 prevents the exciting electrode 228 from being in contact with the metal plate 226 formed on the bottom surface. An exciting electrode 229 is formed on the second side surface of the dielectric block 221 where the clearance portion 225 prevents the exciting electrode 229 from being in contact with the metal plate 226 formed on the bottom surface. One of the exciting electrodes 228 and 229 is used as an input electrode, and the other is used as an output electrode.

Further, a first inductive stub 230 is formed on the third side surface of the dielectric block 221 corresponding to the entire second portion and a second inductive stub 231 is formed on the fourth side surface of the dielectric block 221 corresponding to the entire second portion. The first and second inductive stubs 230 and 231 are in contact with the metal plate 223 formed on the top surface and the metal plate 226 formed on the bottom surface to short-circuit them. These metal plate 222, 223 and 226 are grounded.

No metal plate or electrode is formed on the remaining surfaces of the dielectric block 221, which therefore constitute open ends.

According to the above described structure, the first portion of the dielectric block 221 and the metal plate formed thereon act as a first evanescent waveguide 232, the second portion of the dielectric block 221 and the metal plate formed thereon act as a second evanescent waveguide 233, the third portion of the dielectric block 221 and the metal plate formed thereon act as a first resonator 234, the fourth portion of the dielectric block 221 and the metal plate formed thereon act as a second resonator 235, and the fifth portion of the dielectric block 221 and the metal plate formed thereon act as a third resonator 236. The first evanescent waveguide 232 is an E-mode waveguide, the second evanescent waveguide 233 is an H-mode waveguide, and each of the first to third resonators 234 to 236 is a quarter-wave ($\lambda/4$) dielectric resonator. That is, the bandpass filter 220 is a kind of three-stage bandpass filter employing three resonators.

In the bandpass filter 220, frequency characteristics having sharp edges compared with above described bandpass filters can be obtained by setting the coupling constant k1 between the first resonator 234 and the second resonator 235 and the coupling constant k2 between the second resonator 235 and the third resonator 236 to substantially the same value.

Because, as described above, the bandpass filter 220 according to this embodiment is constituted of the rectangular prismatic dielectric block 221 having no holes or surface irregularities and the metal plates and electrodes formed on the surfaces thereof, even if the overall size of the bandpass filter 220 is reduced, sufficient mechanical strength can be ensured. Moreover, because the bandpass filter 220 according to this embodiment can be fabricated merely by forming various metal plates on the dielectric block 221, the fabrication cost can be substantially reduced.

In the bandpass filter 220, inductive exciting electrodes can be used instead of the capacitive exciting electrodes 228 and 229 as explained with reference to FIGS. 20 to 23. Further, in order to more reduce the overall size, capacitive stubs can be added to the bandpass filter 220 as explained with reference to FIGS. 24 to 43.

Figure 46:
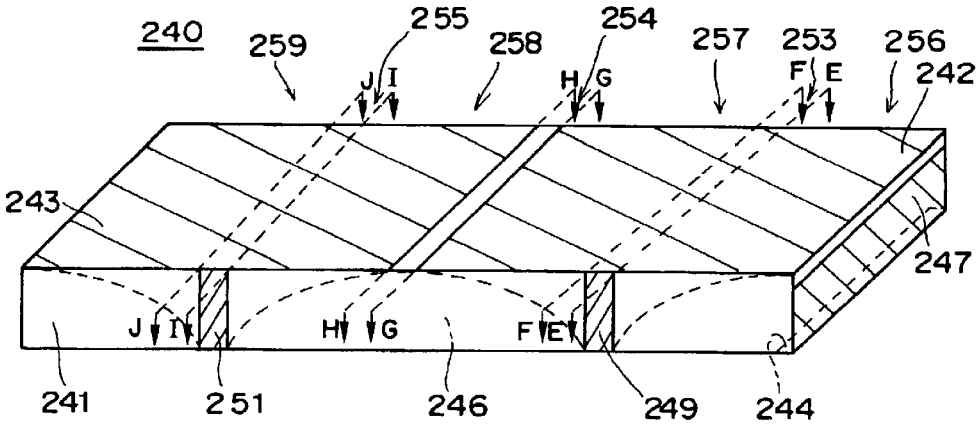
FIG. 46 is a schematic perspective view from one side showing a bandpass filter 240 that is still another preferred embodiment of the present invention.
Figure 47:
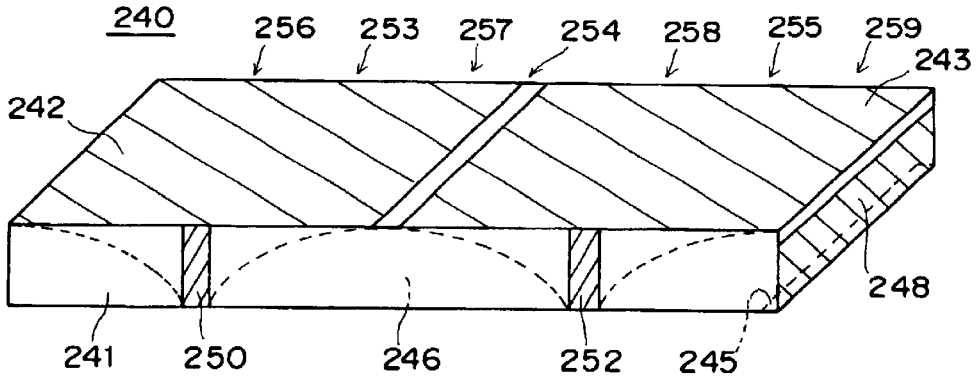
FIG. 47 is a schematic perspective view from the opposite side showing the bandpass filter 240 of FIG. 46.

FIG. 46 is a schematic perspective view from one side showing a bandpass filter 240 that is still another preferred embodiment of the present invention. FIG. 47 is a schematic perspective view from the opposite side showing the bandpass filter 240 of FIG. 46.

As shown in FIGS. 46 and 47, the bandpass filter 240 is constituted of a dielectric block 241 and various metal plates formed on the surface thereof The dielectric block 241 is made of dielectric material whose dielectric constant $\in_r$ is 37, for example, and has the shape of a rectangular prism. That is, the dielectric block 241 has no holes or surface irregularities.

The dielectric block 241 is composed of a first portion lying between an E—E cross-section (first cross-section) and an F—F cross-section (second cross-section) parallel to the first cross-section, a second portion lying between a G—G cross-section (third cross-section) and an H—H cross-section (fourth cross-section) parallel to the third cross-section, a third portion lying between an I—I cross-section (fifth cross-section) and a J—J cross-section (sixth cross-section) parallel to the fifth cross-section, a fourth portion lying between the first side surface and the E—E cross-section (first cross-section), a fifth portion lying between the F—F cross-section (second cross-section) and the G—G cross-section (third cross-section), a sixth portion lying between the H—H cross-section (fourth cross-section) and the I—I cross-section (fifth cross-section), and a seventh portion lying between the second side surface and the J—J cross-section (sixth cross-section). Details will be explained later but the first to third portions constitute a part of first to third evanescent waveguides, respectively, and the fourth to seventh portions constitute a part of first to fourth resonators, respectively.

The definitions of the top surface, bottom surface, and first to fourth side surfaces of the dielectric block 241 are the same as those of the dielectric block 2.

As shown in FIGS. 46 and 47, a metal plate 242 is formed on the top surface of the dielectric block 241 corresponding to the first, fourth and fifth portions and a metal plate 243 is formed on the top surface of the dielectric block 241 corresponding to the third, sixth and seventh portions. A metal plate 246 is formed on the bottom surface of the dielectric block 241 except at clearance portions 244 and 245.

Further, an exciting electrode 247 is formed on the first side surface of the dielectric block 241 where the clearance portion 244 prevents the exciting electrode 247 from being in contact with the metal plate 246 formed on the bottom surface. An exciting electrode 248 is formed on the second side surface of the dielectric block 241 where the clearance portion 245 prevents the exciting electrode 248 from being in contact with the metal plate 246 formed on the bottom surface. One of the exciting electrodes 247 and 248 is used as an input electrode, and the other is used as an output electrode.

A first inductive stub 249 is formed on the third side surface of the dielectric block 241 corresponding to the entire first portion and a second inductive stub 250 is formed on the fourth side surface of the dielectric block 241 corresponding to the entire first portion. The first and second inductive stubs 249 and 250 are in contact with the metal plate 242 formed on the top surface and the metal plate 246 formed on the bottom surface to short-circuit them. Further, a third inductive stub 251 is formed on the third side surface of the dielectric block 241 corresponding to the entire third portion and a fourth inductive stub 252 is formed on the fourth side surface of the dielectric block 241 corresponding to the entire third portion. The third and fourth inductive stubs 251 and 252 are in contact with the metal plate 243 formed on the top surface and the metal plate 246 formed on the bottom surface to short-circuit them. These metal plate 242, 243 and 246 are grounded.

No metal plate or electrode is formed on the remaining surfaces of the dielectric block 241, which therefore constitute open ends.

According to the above described structure, the first portion of the dielectric block 241 and the metal plate formed thereon act as a first evanescent waveguide 253, the second portion of the dielectric block 241 and the metal plate formed thereon act as a second evanescent waveguide 254, the third portion of the dielectric block 241 and the metal plate formed thereon act as a third evanescent waveguide 255, the fourth portion of the dielectric block 241 and the metal plate formed thereon act as a first resonator 256, the fifth portion of the dielectric block 241 and the metal plate formed thereon act as a second resonator 257, the sixth portion of the dielectric block 241 and the metal plate formed thereon act as a third resonator 258, and the seventh portion of the dielectric block 241 and the metal plate formed thereon act as a fourth resonator 259. Each of the first and third evanescent waveguides 253 and 255 is an H-mode waveguide, the second evanescent waveguide 254 is an E-mode waveguide, and each of the first to fourth resonators 256 to 259 is a quarter-wave ($\lambda/4$) dielectric resonator. That is, the bandpass filter 240 is a kind of four-stage bandpass filter employing four resonators.

In the bandpass filter 240, frequency characteristics having sharper edges than the above described bandpass filters can be obtained by setting the coupling constant k1 between the first resonator 256 and the second resonator 257, the coupling constant k2 between the second resonator 257 and the third resonator 258, and the coupling constant k3 between the third resonator 258 and the fourth resonator 259 to substantially the same value.

Because, as described above, the bandpass filter 240 according to this embodiment is constituted of the rectangular prismatic dielectric block 241 having no holes or surface irregularities and the metal plates and electrodes formed on the surfaces thereof, even if the overall size of the bandpass filter 240 is reduced, sufficient mechanical strength can be ensured. Moreover, because the bandpass filter 240 according to this embodiment can be fabricated merely by forming various metal plates on the dielectric block 241, the fabrication cost can be substantially reduced.

In the bandpass filter 240, inductive exciting electrodes can be used instead of the capacitive exciting electrodes 247 and 248 as explained with reference to FIGS. 20 to 23. Further, in order to more reduce the overall size, capacitive stubs can be added to the bandpass filter 240 as explained with reference to FIGS. 24 to 43.

Figure 48:
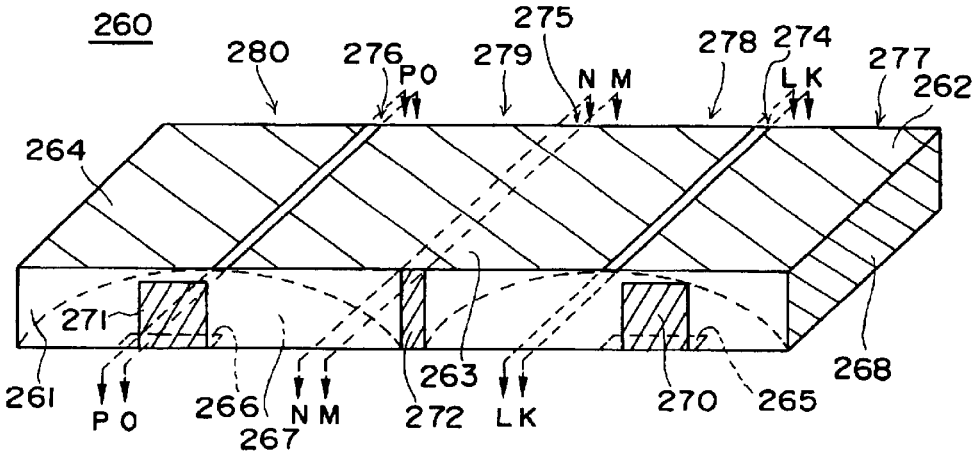
FIG. 48 is a schematic perspective view from one side showing a bandpass filter 260 that is still another preferred embodiment of the present invention.
Figure 49:
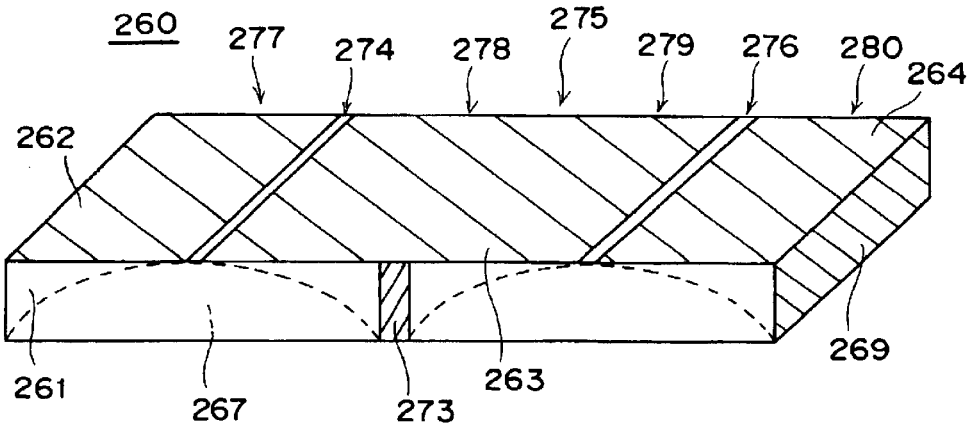
FIG. 49 is a schematic perspective view from the opposite side showing the bandpass filter 260 of FIG. 48.

FIG. 48 is a schematic perspective view from one side showing a bandpass filter 260 that is still another preferred embodiment of the present invention. FIG. 49 is a schematic perspective view from the opposite side showing the bandpass filter 260 of FIG. 48.

As shown in FIGS. 48 and 49, the bandpass filter 260 is constituted of a dielectric block 261 and various metal plates formed on the surface thereof. The dielectric block 261 is made of dielectric material whose dielectric constant $\in_r$ is 37, for example, and has the shape of a rectangular prism. That is, the dielectric block 261 has no holes or surface irregularities.

The dielectric block 261 is composed of a first portion lying between a K—K cross-section (first cross-section) and an L—L cross-section (second cross-section) parallel to the first cross-section, a second portion lying between an M—M cross-section (third cross-section) and an N—N cross-section (fourth cross-section) parallel to the third cross-section, a third portion lying between an O—O cross-section (fifth cross-section) and a P—P cross-section (sixth cross-section) parallel to the fifth cross-section, a fourth portion lying between the first side surface and the K—K cross-section (first cross-section), a fifth portion lying between the L—L cross-section (second cross-section) and the M—M cross-section (third cross-section), a sixth portion lying between the N—N cross-section (fourth cross-section) and the O—O cross-section (fifth cross-section), and a seventh portion lying between the second side surface and the P—P cross-section (sixth cross-section). Details will be explained later but the first to third portions constitute a part of first to third evanescent waveguides, respectively, and the fourth to seventh portions constitute a part of first to fourth resonators, respectively.

The definitions of the top surface, bottom surface, and first to fourth side surfaces of the dielectric block 261 are the same as those of the dielectric block 2.

As shown in FIGS. 48 and 49, a metal plate 262 is formed on the top surface of the dielectric block 261 corresponding to the fourth portion, a metal plate 263 is formed on the top surface of the dielectric block 261 corresponding to the second, fifth and sixth portions, and a metal plate 264 is formed on the top surface of the dielectric block 261 corresponding to the seventh portion. A metal plate 267 is formed on the bottom surface of the dielectric block 261 except at clearance portions 265 and 266. Further, a metal plate 268 is formed on the entire first side surface of the dielectric block 261 and a metal plate 269 is formed on the entire second side surface of the dielectric block 261. The metal plate 268 is in contact with the metal plates 262 and 267 to short-circuit them and the metal plate 269 is in contact with the metal plates 264 and 267 to short-circuit them.

An exciting electrode 270 is formed on the third side surface of the dielectric block 261 corresponding to the fourth portion where the clearance portion 265 prevents the exciting electrode 270 from being in contact with the metal plate 267 formed on the bottom surface. Further, an exciting electrode 271 is formed on the third side surface of the dielectric block 261 corresponding to the seventh portion where the clearance portion 266 prevents the exciting electrode 271 from being in contact with the metal plate 267 formed on the bottom surface. One of the exciting electrodes 270 and 271 is used as an input electrode, and the other is used as an output electrode.

A first inductive stub 273 is formed on the third side surface of the dielectric block 261 corresponding to the entire second portion and a second inductive stub 273 is formed on the fourth side surface of the dielectric block 261 corresponding to the entire second portion. The first and second inductive stubs 272 and 273 are in contact with the metal plate 263 formed on the top surface and the metal plate 267 formed on the bottom surface to short-circuit them. These metal plate 262, 263, 264 and 267 are grounded.

No metal plate or electrode is formed on the remaining surfaces of the dielectric block 261, which therefore constitute open ends.

According to the above described structure, the first portion of the dielectric block 261 and the metal plate formed thereon act as a first evanescent waveguide 274, the second portion of the dielectric block 261 and the metal plate formed thereon act as a second evanescent waveguide 275, the third portion of the dielectric block 261 and the metal plate formed thereon act as a third evanescent waveguide 276, the fourth portion of the dielectric block 261 and the metal plate formed thereon act as a first resonator 277, the fifth portion of the dielectric block 261 and the metal plate formed thereon act as a second resonator 278, the sixth portion of the dielectric block 261 and the metal plate formed thereon act as a third resonator 279, and the seventh portion of the dielectric block 261 and the metal plate formed thereon act as a fourth resonator 280. Each of the first and third evanescent waveguides 274 and 276 is an E-mode waveguide, the second evanescent waveguide 275 is an H-mode waveguide, and each of the first to fourth resonators 277 to 280 is a quarter-wave ($\lambda/4$) dielectric resonator. That is, the bandpass filter 260 is a kind of four-stage bandpass filter employing four resonators.

In the bandpass filter 260, frequency characteristics having sharper edges than the above described bandpass filters can be obtained by setting the coupling constant k1 between the first resonator 277 and the second resonator 278, the coupling constant k2 between the second resonator 278 and the third resonator 279, and the coupling constant k3 between the third resonator 279 and the fourth resonator 280 to substantially the same value.

Because, as described above, the bandpass filter 260 according to this embodiment is constituted of the rectangular prismatic dielectric block 261 having no holes or surface irregularities and the metal plates and electrodes formed on the surfaces thereof, even if the overall size of the bandpass filter 260 is reduced, sufficient mechanical strength can be ensured. Moreover, because the bandpass filter 260 according to this embodiment can be fabricated merely by forming various metal plates on the dielectric block 261, the fabrication cost thereof can be substantially reduced.

In the bandpass filter 260, the inductive exciting electrodes can be used instead of the capacitive exciting electrodes 270 and 271 as explained with reference to FIGS. 20 to 23. Further, in order to more reduce the overall size, capacitive stubs can be added to the bandpass filter 260 as explained with reference to FIGS. 24 to 43.

The present invention has thus been shown and described with reference to specific embodiments. However, it should be noted that the present invention is in no way limited to the details of the described arrangements but changes and modifications may be made without departing from the scope of the appended claims.

For example, in the above described embodiments, the dielectric block portions for the resonators and the evanescent waveguide are made of dielectric material whose dielectric constant $\in_r$ is 37. However, a material having a different dielectric constant can be used according to purpose.

Further, the dimensions of the resonators and the evanescent waveguide specified in the above-described embodiments are only examples. Resonators and an evanescent waveguide having different dimensions can be used according to purpose.

Further, in the bandpass filters 150, 180, 180', 200, and 200', the capacitive stubs are formed such that they are in contact with the metal plates formed on bottom surface of the dielectric block. However, the present invention is not limited to the capacitive stubs being in contact with the metal plates formed on the bottom surface and they can be formed separately from the metal plates. It is worth noting that to obtain the effects efficiently it is preferable that the capacitive stubs and the metal plates formed on the bottom surface be connected.

As described above, because the bandpass filter according to the present invention is constituted of the rectangular prismatic dielectric block having no holes or surface irregularities and the metal plates, the exciting electrodes, and the inductive stubs formed on the surfaces thereof, the mechanical strength is extremely high compared with conventional filters. Thus, even if the overall size of the bandpass filter is reduced, sufficient mechanical strength can be ensured. Moreover, because the bandpass filter according to the present invention can be fabricated merely by forming various metal plates and so forth on the dielectric block, and forming of holes or irregularities is not necessary as in conventional filters, the fabrication cost can be substantially reduced.

Further, when the capacitive stubs are provided in the bandpass filter according to the present invention, the overall size of the bandpass filter can be further reduced and radiation loss can be lowered.

Therefore, the present invention provides a bandpass filter that can be preferably utilized in communication terminals such as mobile phones and the like, Wireless LANs (Local Area Networks), and ITS (Intelligent Transport Systems) and the like.

What is claimed is:

1. A bandpass filter comprising:

a dielectric block of substantially rectangular prismatic shape having a top surface, a bottom surface, a first portion, a second portion and a third portion, the first portion lying between a first cross-section of the dielectric block and a second cross-section of the dielectric block substantially parallel to the first cross-section and the second and third portions divided by the first portion the first portion being positioned between the second and third portions;

a top metal plate formed on substantially the entire top surface of the dielectric block;

and bottom metal plate formed on substantially the entire bottom surface of the dielectric block;

a metal layer formed on a first and second surface of the dielectric block extending from the top surface to the bottom surface of the entire first portion to electrically couple the top and bottom metal plates to each other at the first portion thereby enabling the first portion of the dielectric block and the metal plates formed thereon to act as an evanescent waveguide;

an electrical isolation region positioned on the first and second surfaces of the dielectric block between the top metal plate and bottom metal plate at the entire second portion of the dielectric block such that the metal plates formed thereon to act as a first resonator, and an electrical isolation region positioned on the first and second surfaces of the dielectric block between the top metal plate and bottom metal plate at the entire third portion of the dielectric block such that the metal plates formed thereon to act as a second resonator and the top and bottom metal plates are electrically isolated from each other at the entire second and third portions.

2. The bandpass filter as claimed in claim 1, wherein inductive stubs are formed on two opposite surfaces of the first portion of the dielectric block.

3. The bandpass filter as claimed in claim 1, wherein the metal plates further include a portion formed on substantially all of a surface of the dielectric block which is substantially perpendicular to the surface on which the inductive stub is formed.

4. The bandpass filter as claimed in claim 1, wherein the metal plates further include a capacitive stub formed on the surfaces of the second and third portions of the dielectric block.

5. The bandpass filter as claimed in claim 1, wherein the bandpass filter is symmetrical with respect to a cross-section that divides the dielectric block in half.

6. The bandpass filter as claimed in claim 1, wherein the bandpass filter is symmetrical with respect to an axis passing through a center of the dielectric block.

7. A bandpass filter comprising:

a dielectric block having a top surface, a bottom surface, first and second side surfaces opposite to each other and third and fourth side surfaces opposite to each other, the dielectric block being constituted of a first portion lying between a first cross-section of the dielectric block substantially parallel to the first side surface and a second cross-section of the dielectric block substantially parallel to the first cross-section, a second portion lying between the first side surface and the first cross-section, and a third portion lying between the second side surface and the second cross-section;

a first metal plate formed on the top surface of the dielectric block;

a second metal plate formed on the bottom surface of the dielectric block;

a first exciting electrode formed on at least one of the first side surface, the third side surface, the fourth side surface, and the bottom surface of the second portion of the dielectric block;

a second exciting electrode formed on at least one of the second side surface, the third side surface, the fourth side surface, and the bottom surface of the third portion of the dielectric block;

a first inductive stub formed on substantially all of the third side surface of the first portion of the dielectric block; and a second inductive stub formed on substantially all of the fourth side surface of the first portion of the dielectric block; and an electrical insulation region extending between the first and second metal plates for the entire region between the second and third portions.

8. The bandpass filter as claimed in claim 7, wherein the bandpass filter is substantially a rectangular prism in overall shape.

9. The bandpass filter as claimed in claim 7, wherein the first metal plate and the second metal plate are short-circuited by the first and second inductive stubs.

10. The bandpass filter as claimed in claim 7, wherein the second metal plate and the first exciting electrode are prevented from connecting and the second metal plate and the second exciting electrode are prevented from connecting.

11. The bandpass filter as claimed in claim 7, further comprising a first capacitive stub formed on at least one of the third and fourth side surfaces of the second portion of the dielectric block and a second capacitive stub formed on at least one of the third and fourth side surfaces of the third portion of the dielectric block.

12. The bandpass filter as claimed in claim 11, wherein both the first and second capacitive stubs are connected to the second metal plate.

13. The bandpass filter as claimed in claim 11, further comprising a third capacitive stub formed on the first side surface of the dielectric block and a fourth capacitive stub formed on the second side surface of the dielectric block.

14. The bandpass filter as claimed in claim 13, wherein the first capacitive stub and the third capacitive stub are connected to each other and the second capacitive stub and the fourth capacitive stub are connected to each other.

15. The bandpass filter as claimed in claim 7, wherein the bandpass filter is symmetrical with respect to a cross-section that divides the dielectric block in half.

16. The bandpass filter as claimed in claim 7, wherein the bandpass filter is symmetrical with respect to an axis passing through a center of the dielectric block.

17. The bandpass filter as claimed in claim 7, wherein the second portion of the dielectric block and a part of the first and second metal plates formed thereon are enabled to act as a first quarter-wave dielectric resonator and the third portion of the dielectric block and another part of the first and second metal plates formed thereon are enabled to act as a second quarter-wave dielectric resonator.

18. A bandpass filter, comprising:

a dielectric block having a top surface, a bottom surface, first and second side surfaces opposite to each other and third and fourth side surfaces opposite to each other, the dielectric block being constituted of a first portion lying between a first cross-section of the dielectric block substantially parallel to the first side surface and a second cross-section of the dielectric block substantially parallel to the first cross-section, a second portion lying between the first side surface and the first cross-section, and a third portion lying between the second side surface and the second cross-section; and metal plates formed on the top and bottom surfaces of the dielectric block, and on the third and fourth side surfaces of the first portion to short circuit the metal plates on the top and bottom surfaces to each other; and an electrical insulation region extending between the first and second metal plates for the entire region between the second and third portions;

whereby a first resonation circuit is established in which the first side surface acts as its open end and the first cross-section acts as its short end and a second resonation circuit is established in which the second side surface acts as its open end and the second cross-section acts as its short end, the bandpass filter further comprising means for providing a $\pi$-type inductive circuit between the first resonation circuit and the second resonation circuit.

19. The bandpass filter as claimed in claim 18, wherein the bandpass filter is substantially a rectangular prism in overall shape.

20. The bandpass filter as claimed in claim 18, further comprising means for establishing a first additional capacitance parallel to the first resonation circuit and means for providing a second additional capacitance parallel to the second resonation circuit.

21. A bandpass filter comprising first and second quarter-wave dielectric resonators each having an open end and a short end opposite to the open end and having metal plates provided on top and bottom surfaces and a first evanescent waveguide provided between the short end of the first quarter-wave dielectric resonator and the short end of the second quarter-wave dielectric resonator, the bandpass filter being substantially a rectangular prism in overall shape.

22. The bandpass filter as claimed in claim 21, further comprising a third quarter-wave dielectric resonator having an open end and a short end opposite to the open end and having metal plates provided on top and bottom surfaces and a second evanescent waveguide provided between the open end of the second quarter-wave dielectric resonator and the open end of the third quarter-wave dielectric resonator.

23. The bandpass filter as claimed in claim 22, further comprising a fourth quarter-wave dielectric resonator having an open end and a short end opposite to the open end and having metal plates provided on top and bottom surfaces and a third evanescent waveguide provided between the short end of the third quarter-wave dielectric resonator and the short end of the fourth quarter-wave dielectric resonator.

24. The bandpass filter as claimed in claim 22, further comprising a fourth quarter-wave dielectric resonator having an open end and a short end opposite to the open end and having metal plates provided on top and bottom surfaces and a third evanescent waveguide provided between the open end of the first quarter-wave dielectric resonator and the open end of the fourth quarter-wave dielectric resonator.

* * * * *

UNITED STATES PATENT AND TRADEMARK OFFICE

CERTIFICATE OF CORRECTION

PATENT NO. : 6,850,131 B2
DATED : February 1, 2005
INVENTOR(S) : Arun Chandra Kundu It is certified that error appears in the above-identified patent and that said Letters Patent is hereby corrected as shown below:

Column 32,
Lines 48 and 53, “an electrical isolation region” should read -- a dielectric material --.

Column 33,
Line 41, “an electrical insulation region” should read -- a dielectric material --.

Column 35,
Line 35, “an electrical insulation region” should read -- a dielectric material --.

Signed and Sealed this

Fourteenth Day of February, 2006

JON W. DUDAS
*Director of the United States Patent and Trademark Office*